US010455869B1

(12) United States Patent
Dille et al.

(10) Patent No.: US 10,455,869 B1
(45) Date of Patent: Oct. 29, 2019

(54) TECHNOLOGIES FOR TOOL CARRYING

(71) Applicant: Titan Retention LLC, San Diego, CA (US)

(72) Inventors: Dylan Dille, San Diego, CA (US); Krista Dille, San Diego, CA (US)

(73) Assignee: Titan Retention LLC, Pine, CO (US)

( * ) Notice: Subject to any disclaimer, the term of this patent is extended or adjusted under 35 U.S.C. 154(b) by 75 days.

(21) Appl. No.: 15/446,884

(22) Filed: Mar. 1, 2017

Related U.S. Application Data

(60) Provisional application No. 62/318,598, filed on Apr. 5, 2016, provisional application No. 62/343,662, filed on May 31, 2016.

(51) Int. Cl.
*A41D 13/05* (2006.01)
*F42B 39/02* (2006.01)

(52) U.S. Cl.
CPC ..... *A41D 13/0568* (2013.01); *A41D 13/0518* (2013.01); *F42B 39/02* (2013.01)

(58) Field of Classification Search
CPC .. A41D 13/0568; A41D 13/0518; A41D 1/04; A41D 2200/10; F41H 1/02; F42B 39/02; A45F 2003/047; A45F 2003/045; A45F 3/06; A63C 10/06
USPC ..... 2/462–465; 224/637, 262
See application file for complete search history.

(56) References Cited

U.S. PATENT DOCUMENTS 2,111,361 A * 3/1938 Engelson ..... A41B 1/02 2/103
4,555,051 A 11/1985 Johnson
5,422,260 A 7/1995 Rock
5,927,574 A 7/1999 Ruesink
6,056,300 A * 5/2000 Carpenter ..... A63C 10/04 24/DIG. 51
6,119,907 A 9/2000 Benjamin
6,431,424 B1 8/2002 Smith
7,069,624 B2 7/2006 Johnson
7,856,672 B1 12/2010 Koehler
8,146,211 B2 4/2012 Shirai et al.
8,650,794 B2 2/2014 Swan et al.
9,194,655 B1 11/2015 Cha
9,241,543 B1 1/2016 Peng
9,370,223 B1 6/2016 Taylor
2003/0173390 A1* 9/2003 Smith ..... A01K 97/06 224/604
2006/0151563 A1 7/2006 Bussard
2012/0297527 A1* 11/2012 Darnell ..... F41H 1/02 2/455
2014/0367427 A1 12/2014 Bjelde et al.

FOREIGN PATENT DOCUMENTS

DE 4329492 3/1995
DE 4329492 A1 * 3/1995 ..... A44B 11/20

OTHER PUBLICATIONS

DE4329492, published on Mar. 2, 1995, Machine translation (10 pages).

* cited by examiner

*Primary Examiner* — Katharine Gracz
*Assistant Examiner* — Aiying Zhao
(74) *Attorney, Agent, or Firm* — Dentons US LLP

(57) ABSTRACT

A device includes a strap and an adjustment mechanism coupled to the strap.

13 Claims, 29 Drawing Sheets

230
216
232
212
206c
214
210
208
208a
206
206a
204a
204

230
216
218
232
212
214
210
208
206
206a
208a
204a
204

230
216
218a
218b
218
232
207
212
214
210
210a
206b
208a
206
205
204a
204

TECHNOLOGIES FOR TOOL CARRYING

CROSS-REFERENCE TO RELATED APPLICATIONS

This application claims the benefit of priority to (1) U.S. Provisional Patent Application 62/318,598 filed 5 Apr. 2016, and (2) U.S. Provisional Patent Application 62/343,662 filed 31 May 2016, each of which is herein fully incorporated by reference for all purposes.

COPYRIGHT NOTICE

A portion of this disclosure contains material which is subject to copyright protection. An owner of this copyright has no objection to a facsimile reproduction by anyone of this document, as this document appears in USPTO records, but otherwise reserves all copyright rights whatsoever.

TECHNICAL FIELD

This disclosure relates to tool carrying.

BACKGROUND

In this disclosure, where a document, an act, and/or an item of knowledge is referred to and/or discussed, then such reference and/or discussion is not an admission that the document, the act, and/or the item of knowledge and/or any combination thereof was at a priority date, publicly available, known to a public, part of common general knowledge, and/or otherwise constitutes any prior art under any applicable statutory provisions; and/or is known to be relevant to any attempt to solve any problem with which this disclosure is concerned with. Further, nothing is disclaimed.

While a user is operating a shoulder-fired-weapon, such as a missile launcher, or a rifle, there are activities when the user desires to stow away the shoulder-fired-weapon or the rifle in order to enable free hand use. Some of such activities may include swinging a sledgehammer, operating a chainsaw, or engaging in hand-to-hand combat. However, during such activities, the should-fired-weapon may swing violently, such as back-and-forth along a lateral plane of the user, even when the shoulder-fired weapon is stowed away. Although various weapon retention systems exist, such systems are inadequate for the free hand use due to several reasons. For example, some of such systems include elastic cords, which typically lack tension required to effectively retain weapons. Other such systems lack any means of adjustment for different size users/body armor configurations or lack durable quick attach/detach buckles/attachment systems.

When the user wears a ballistic vest, such as a body armor plate carrier, an emergency event may arise where the ballistic vest may need to be expediently released from the user, along with any weapons retention system attached thereto, such as when the user is floating or swimming in a body of water. Currently, there are no weapons retention systems that fall away with the ballistic vest. For example, various weapon retention systems mount to a back plate of the ballistic vest and are secured on either a cummerbund of the ballistic vest or a front plate of the ballistic vest. Such configuration creates a fixed hard point that voids an emergency quick release system of the ballistic vest and may cause an entanglement with the user, which may be dangerous if the user is floating or swimming in the body of water, such as due to drowning from the entanglement.

SUMMARY

This disclosure at least partially addresses at least one of above inefficiencies. However, this disclosure can prove useful to other technical areas. Therefore, various claims recited below should not be construed as necessarily limited to addressing any of the above inefficiencies.

According to an embodiment of this disclosure, a device comprises a vest including a front section and a back section; a strap including a first strap end portion and a second strap end portion, wherein the first strap end portion is coupled to the front section; a linear rack including a first rack end portion and a second rack end portion, wherein the first rack end portion is coupled to the first strap end portion; and a pawl engaging the linear rack, wherein the pawl is coupled to the strap between the first strap end portion and the second strap end portion such that a distance between the pawl and the first strap end portion is decreased as the pawl engages the linear rack away from the second rack end portion towards the first rack end portion and such that the distance between the pawl and the first strap end portion is increased as the pawl disengages the linear rack away from the first rack end portion towards the second rack end portion.

According to an embodiment of this disclosure, a method comprises coupling a first strap end portion of a strap to a front section of a vest, wherein the vest includes a back section, wherein the strap includes a second strap end portion; coupling a first rack end portion of a linear rack to the first strap end portion, wherein the linear rack includes a second rack end portion extending over the strap; and engaging a pawl to the linear rack, wherein the pawl is coupled to the strap between the first strap end portion and the second strap end portion such that a distance between the pawl and the first strap end portion is decreased as the pawl engages the linear rack away from the second rack end portion towards the first rack end portion and such that the distance between the pawl and the first strap end portion is increased as the pawl disengages the linear rack away from the first rack end portion towards the second rack end portion.

According to an embodiment of this disclosure, a device comprises a vest including a front section, a shoulder section, and a back section, wherein the back section includes a loop; a lateral strap coupled to the front section and to the back section; a cord extending from the shoulder section through the loop such that the lateral strap is uncoupled from the back section when the cord is pulled from the shoulder section and the vest is unsecured from a user thereof.

This disclosure is embodied in various forms illustrated in a set of accompanying illustrative drawings. Note that variations are contemplated as being a part of this disclosure, limited only by a scope of various claims recited below.

BRIEF DESCRIPTION OF DRAWINGS

The set of accompanying illustrative drawings shows various example embodiments of this disclosure. Such drawings are not to be construed as necessarily limiting this disclosure. Like numbers and/or similar numbering scheme can refer to like and/or similar elements throughout.

DETAILED DESCRIPTION OF PREFERRED EMBODIMENTS

Figure 1:
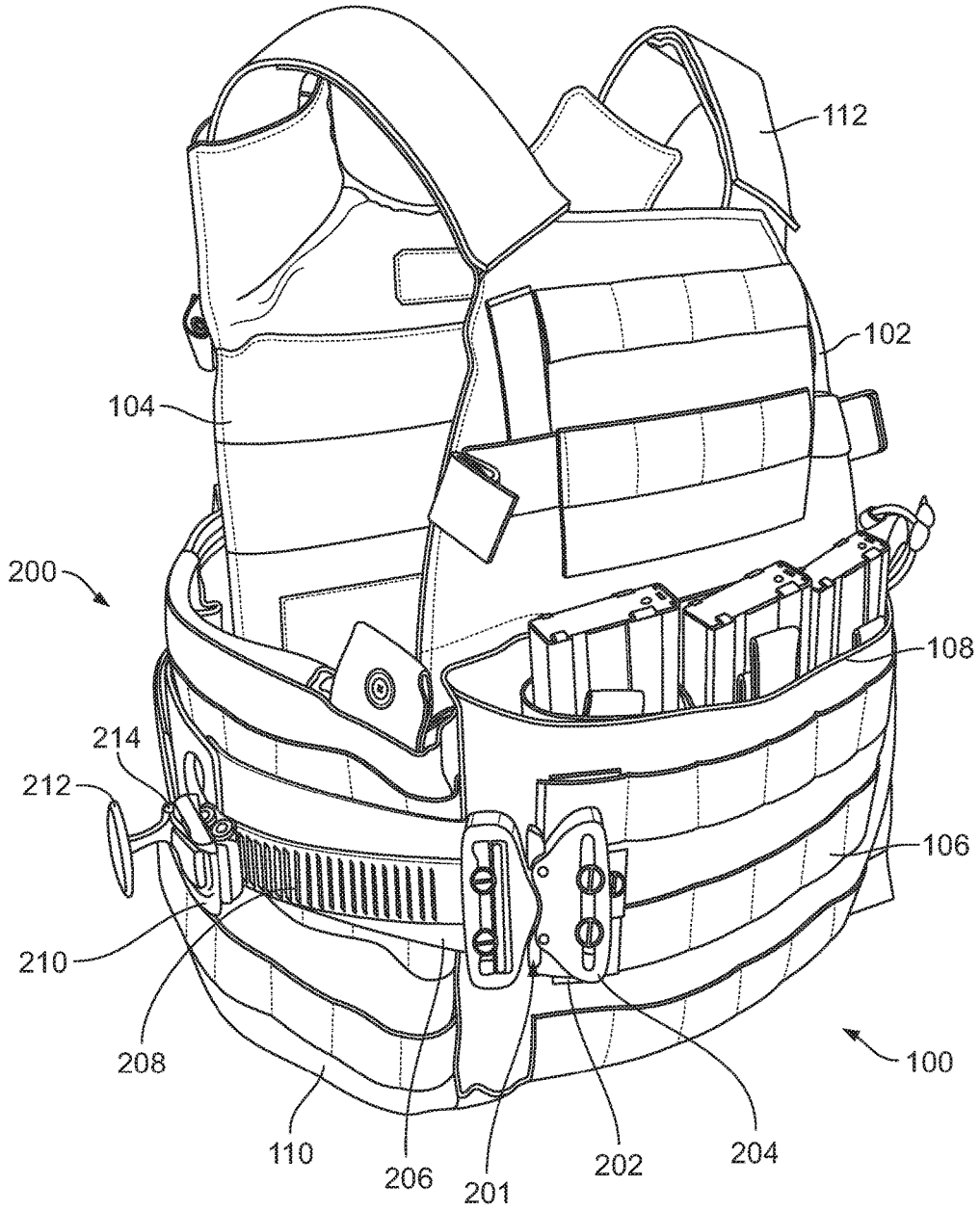
FIGS. 1-3 show various perspective views of a ballistic vest with a tool retention system according to this disclosure.

This disclosure is now described more fully with reference to the set of accompanying illustrative drawings, in which example embodiments of this disclosure are shown. This disclosure can be embodied in many different forms and should not be construed as necessarily being limited to the example embodiments disclosed herein. Rather, the example embodiments are provided so that this disclosure is thorough and complete, and fully conveys various concepts of this disclosure to those skilled in a relevant art.

Features described with respect to certain example embodiments can be combined and sub-combined in and/or with various other example embodiments. Also, different aspects and/or elements of example embodiments, as disclosed herein, can be combined and sub-combined in a similar manner as well. Further, some example embodiments, whether individually and/or collectively, can be components of a larger system, wherein other procedures can take precedence over and/or otherwise modify their application. Additionally, a number of steps can be required before, after, and/or concurrently with example embodiments, as disclosed herein. Note that any and/or all methods and/or processes, at least as disclosed herein, can be at least partially performed via at least one entity in any manner.

Various terminology used herein can imply direct or indirect, full or partial, temporary or permanent, action or inaction. For example, when an element is referred to as being "on," "connected" or "coupled" to another element, then the element can be directly on, connected or coupled to the other element and/or intervening elements can be present, including indirect and/or direct variants. In contrast, when an element is referred to as being "directly connected" or "directly coupled" to another element, there are no intervening elements present.

Although the terms first, second, etc. can be used herein to describe various elements, components, regions, layers and/or sections, these elements, components, regions, layers and/or sections should not necessarily be limited by such terms. These terms are used to distinguish one element, component, region, layer or section from another element, component, region, layer or section. Thus, a first element, component, region, layer, or section discussed below could be termed a second element, component, region, layer, or section without departing from various teachings of this disclosure.

Various terminology used herein is for describing particular example embodiments and is not intended to be necessarily limiting of this disclosure. As used herein, various singular forms "a," "an" and "the" are intended to include various plural forms as well, unless a context clearly indicates otherwise. Various terms "comprises," "includes" and/or "comprising," "including" when used in this specification, specify a presence of stated features, integers, steps, operations, elements, and/or components, but do not preclude the presence and/or addition of one or more other features, integers, steps, operations, elements, components, and/or groups thereof.

As used herein, a term "or" is intended to mean an inclusive "or" rather than an exclusive "or." That is, unless specified otherwise, or clear from context, "X employs A or B" is intended to mean any of a set of natural inclusive permutations. That is, if X employs A; X employs B; or X employs both A and B, then "X employs A or B" is satisfied under any of the foregoing instances.

Example embodiments of this disclosure are described herein with reference to illustrations of idealized embodiments (and intermediate structures) of this disclosure. As such, variations from various illustrated shapes as a result, for example, of manufacturing techniques and/or tolerances, are to be expected. Thus, various example embodiments of this disclosure should not be construed as necessarily limited to various particular shapes of regions illustrated herein, but are to include deviations in shapes that result, for example, from manufacturing.

Any and/or all elements, as disclosed herein, can be formed from a same, structurally continuous piece, such as being unitary, and/or be separately manufactured and/or connected, such as being an assembly and/or modules. Any and/or all elements, as disclosed herein, can be manufactured via any manufacturing processes, whether additive manufacturing, subtractive manufacturing, and/or other any other types of manufacturing. For example, some manufacturing processes include three dimensional (3D) printing, laser cutting, computer numerical control routing, milling, pressing, stamping, vacuum forming, hydroforming, injection molding, lithography, and so forth.

Any and/or all elements, as disclosed herein, can be and/or include, whether partially and/or fully, a solid, including a metal, a mineral, an amorphous material, a ceramic, a glass ceramic, an organic solid, such as wood and/or a polymer, such as rubber, a composite material, a semiconductor, a nanomaterial, a biomaterial and/or any combinations thereof. Any and/or all elements, as disclosed herein, can be and/or include, whether partially and/or fully, a coating, including an informational coating, such as ink, an adhesive coating, a melt-adhesive coating, such as vacuum seal and/or heat seal, a release coating, such as tape liner, a low surface energy coating, an optical coating, such as for tint, color, hue, saturation, tone, shade, transparency, translucency, opaqueness, luminescence, reflection, phosphorescence, anti-reflection and/or holography, a photo-sensitive coating, an electronic and/or thermal property coating, such as for passivity, insulation, resistance or conduction, a magnetic coating, a water-resistant and/or waterproof coating, a scent coating and/or any combinations thereof. Any and/or all elements, as disclosed herein, can be rigid, flexible, and/or any other combinations thereof. Any and/or all elements, as disclosed herein, can be identical and/or different from each other in material, shape, size, color and/or any measurable dimension, such as length, width, height, depth, area, orientation, perimeter, volume, breadth, density, temperature, resistance, and so forth.

Unless otherwise defined, all terms (including technical and scientific terms) used herein have the same meaning as commonly understood by one of ordinary skill in an art to which this disclosure belongs. Various terms, such as those defined in commonly used dictionaries, should be interpreted as having a meaning that is consistent with a meaning in a context of a relevant art and should not be interpreted in an idealized and/or overly formal sense unless expressly so defined herein.

Furthermore, relative terms such as "below," "lower," "above," and "upper" can be used herein to describe one element's relationship to another element as illustrated in the set of accompanying illustrative drawings. Such relative terms are intended to encompass different orientations of illustrated technologies in addition to an orientation depicted in the set of accompanying illustrative drawings. For example, if a device in the set of accompanying illustrative drawings were turned over, then various elements described as being on a "lower" side of other elements would then be oriented on "upper" sides of other elements. Similarly, if a device in one of illustrative figures were turned over, then various elements described as "below" or "beneath" other elements would then be oriented "above" other elements. Therefore, various example terms "below" and "lower" can encompass both an orientation of above and below.

As used herein, a term "about" and/or "substantially" refers to a +/−10% variation from a nominal value/term. Such variation is always included in any given value/term provided herein, whether or not such variation is specifically referred thereto.

If any disclosures are incorporated herein by reference and such disclosures conflict in part and/or in whole with this disclosure, then to an extent of a conflict, if any, and/or a broader disclosure, and/or broader definition of terms, this disclosure controls. If such disclosures conflict in part and/or in whole with one another, then to an extent of a conflict, if any, a later-dated disclosure controls.

Figure 2:
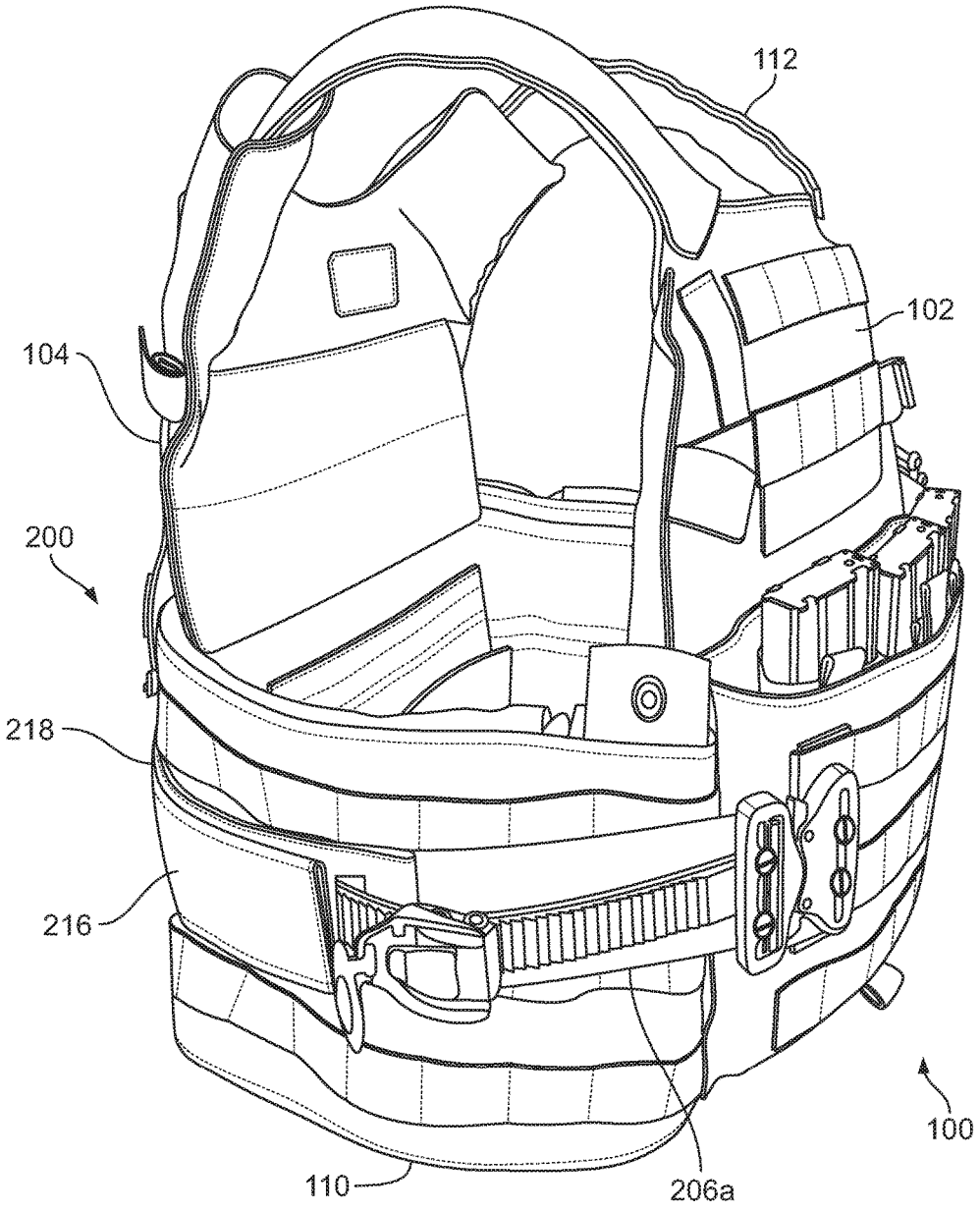
Figure 3:
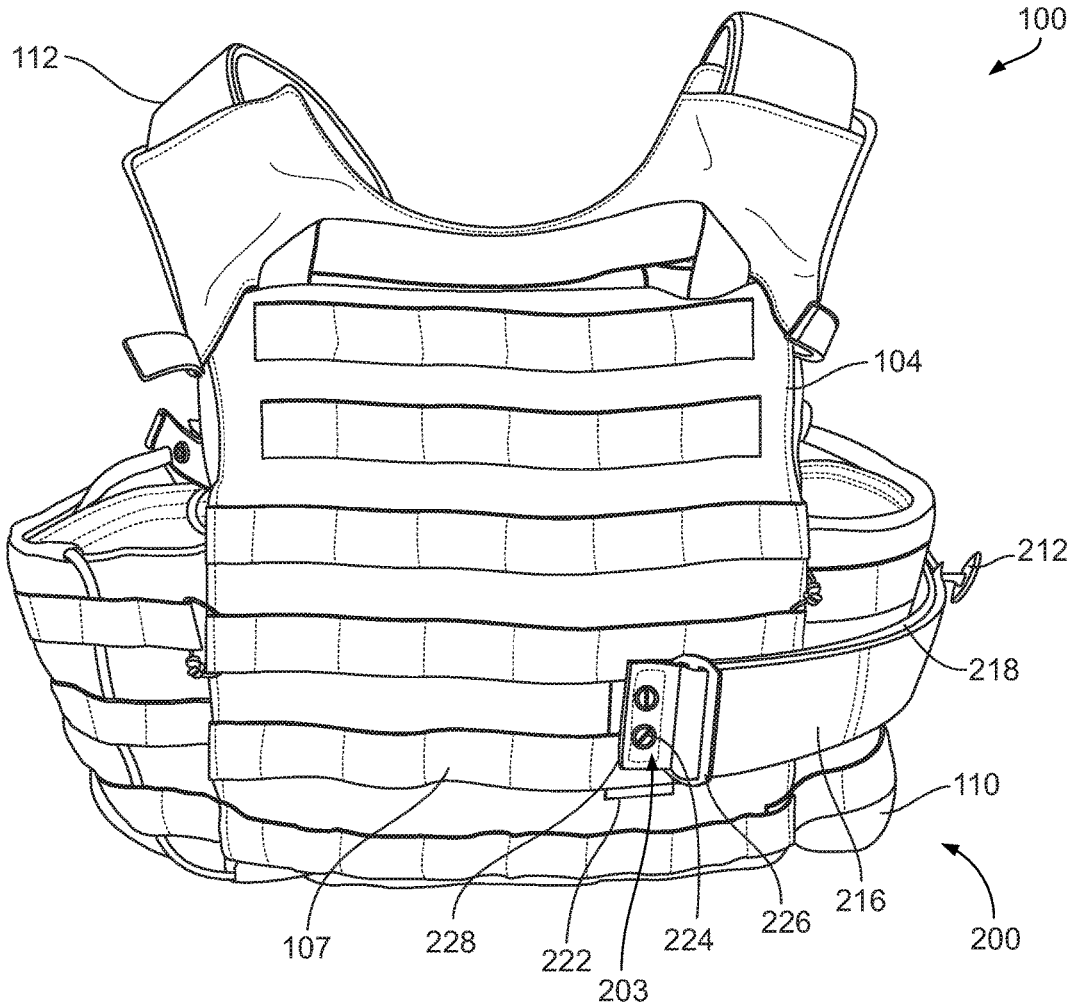
Figures 4A, 4B, 4C:
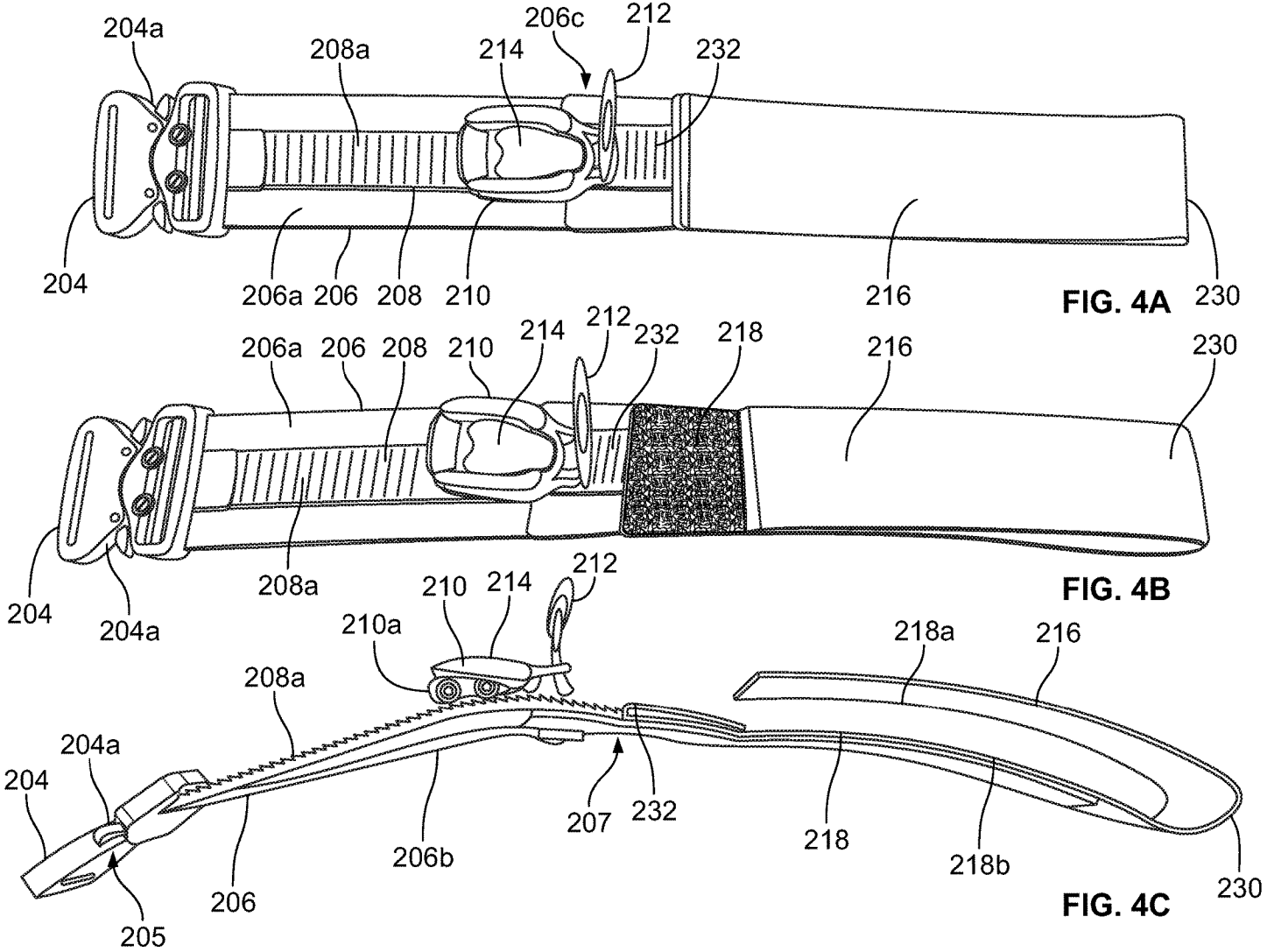
FIGS. 4A-4C show a top view, a perspective top view, and a profile view of a tool retention system according to this disclosure.
Figure 9A:
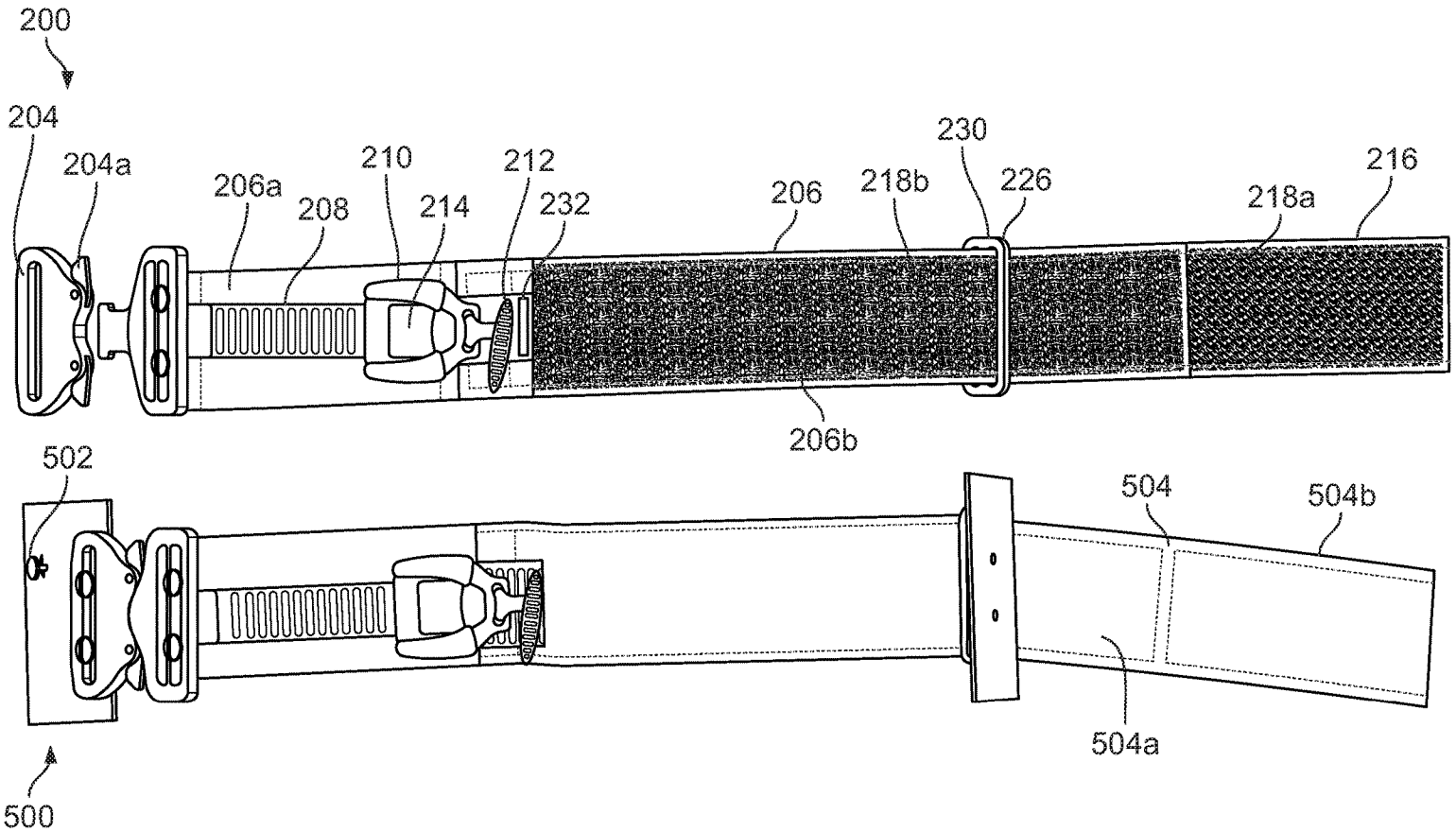
FIG. 9A shows a top view of a pair of first sides of a pair of tool retention systems according to this disclosure.
Figure 9B:
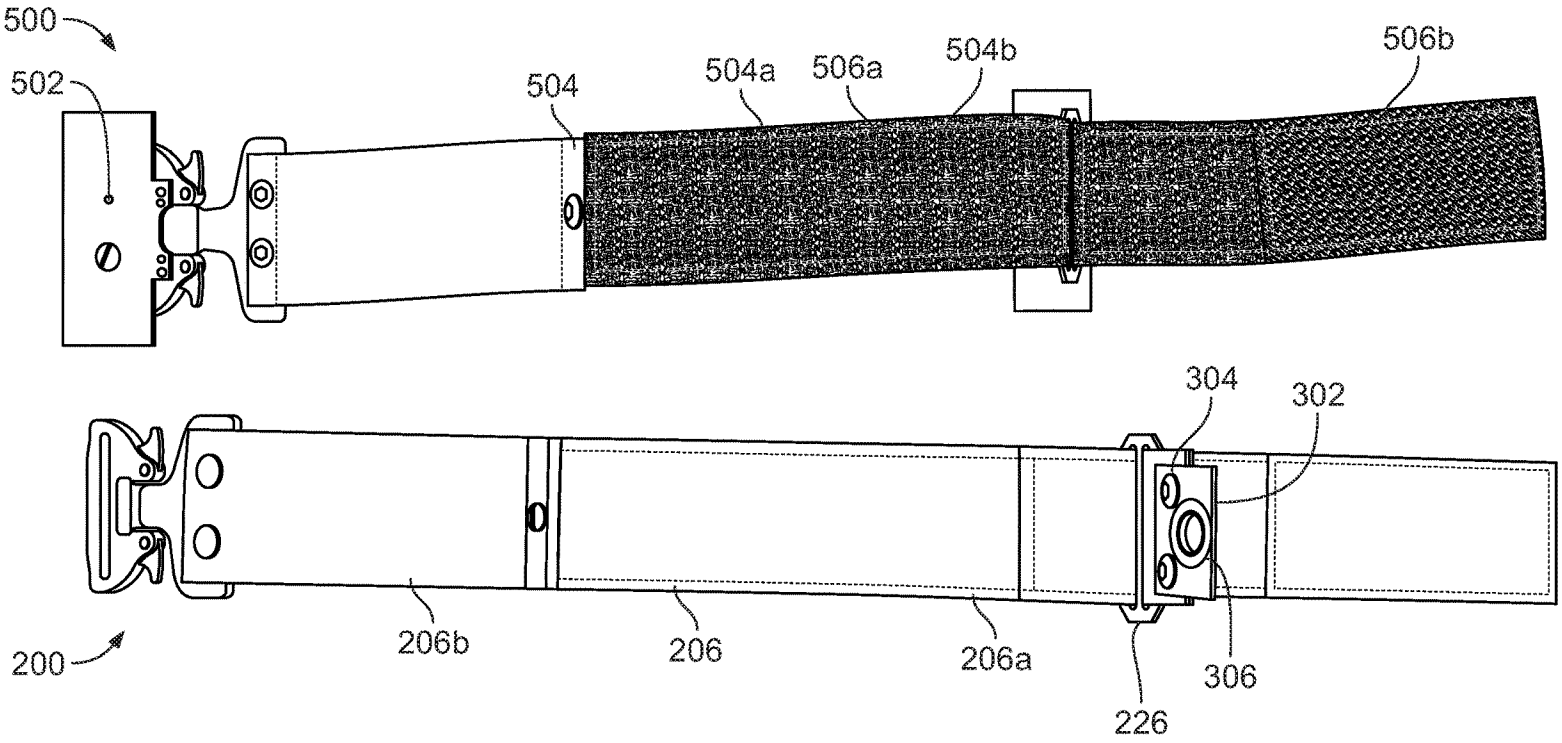
FIG. 9B shows a top view of a pair of second sides of a pair of tool retention systems according to this disclosure.
Figure 10A:
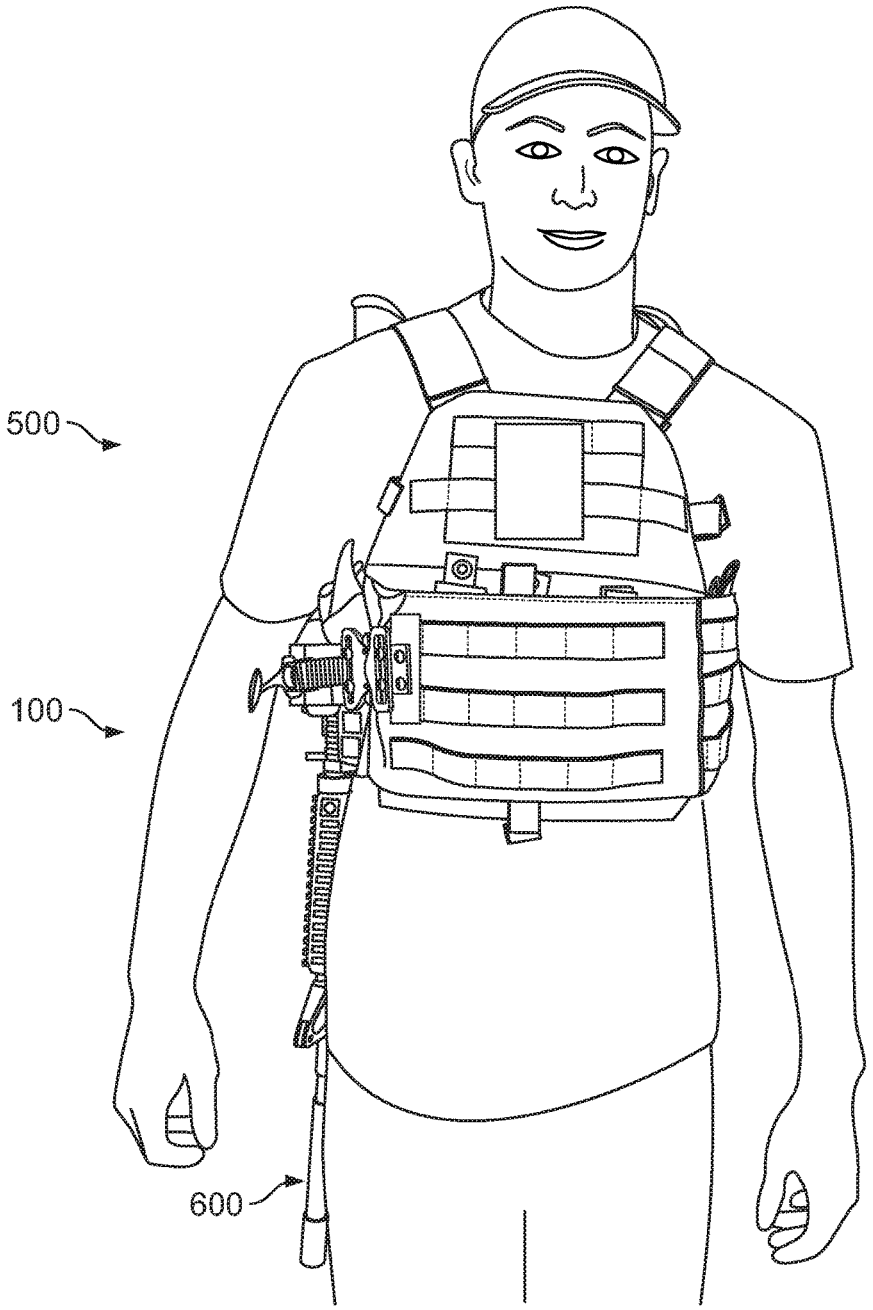
FIGS. 10A-10D show various views of a user wearing a ballistic vest with a tool retention system supporting a tool according to this disclosure.
Figure 10B:
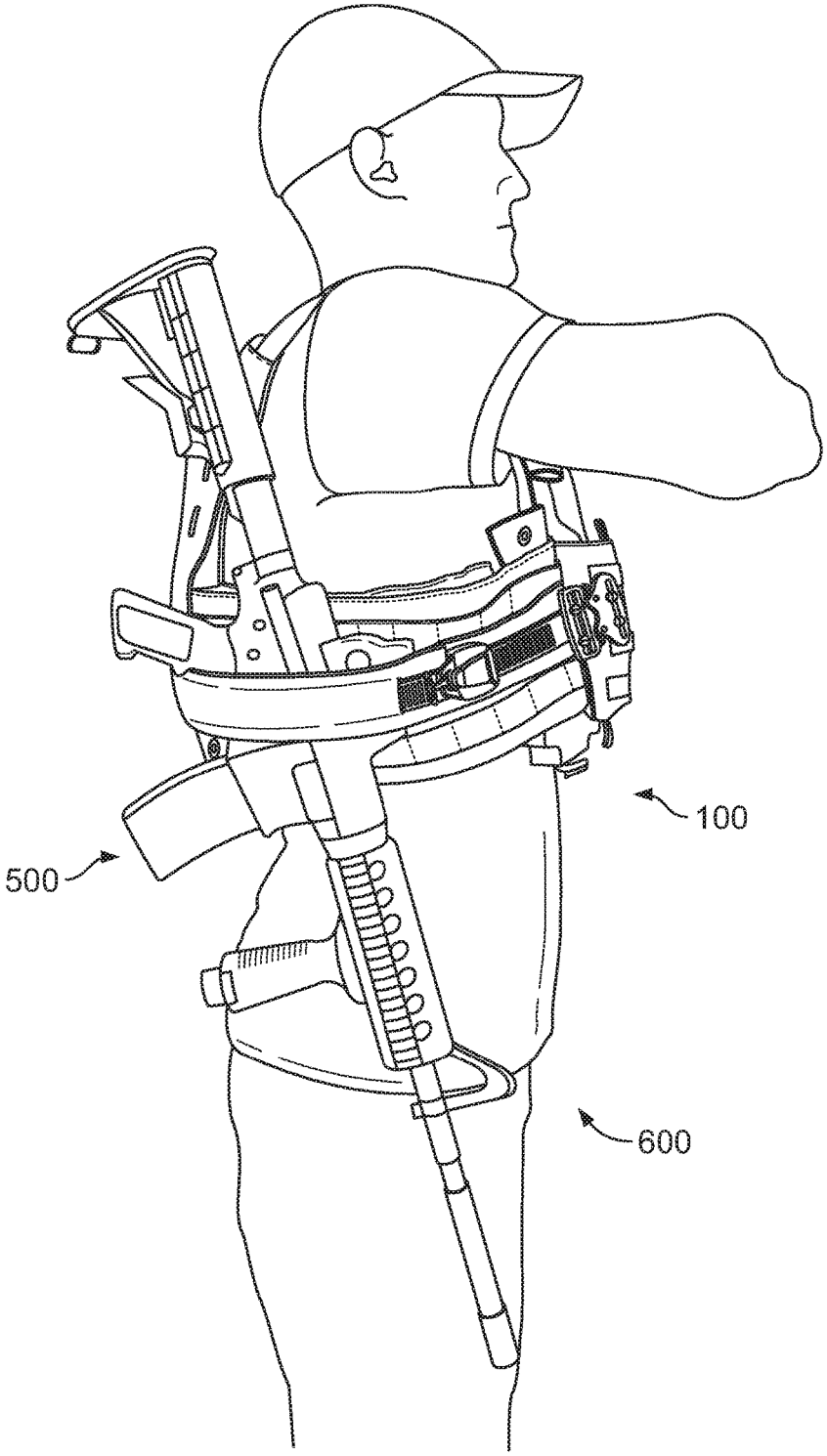
Figure 10C:
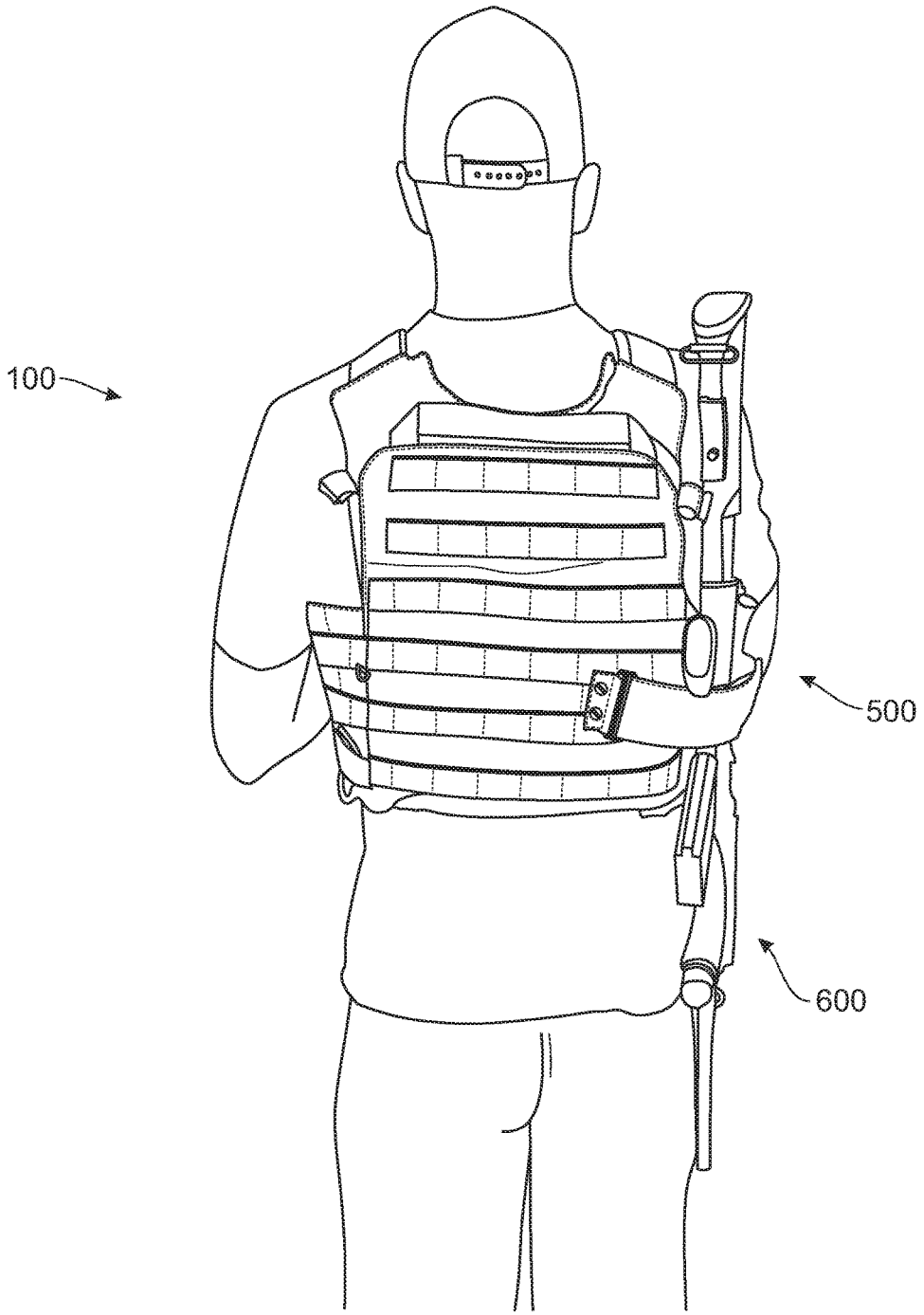
Figure 10D:
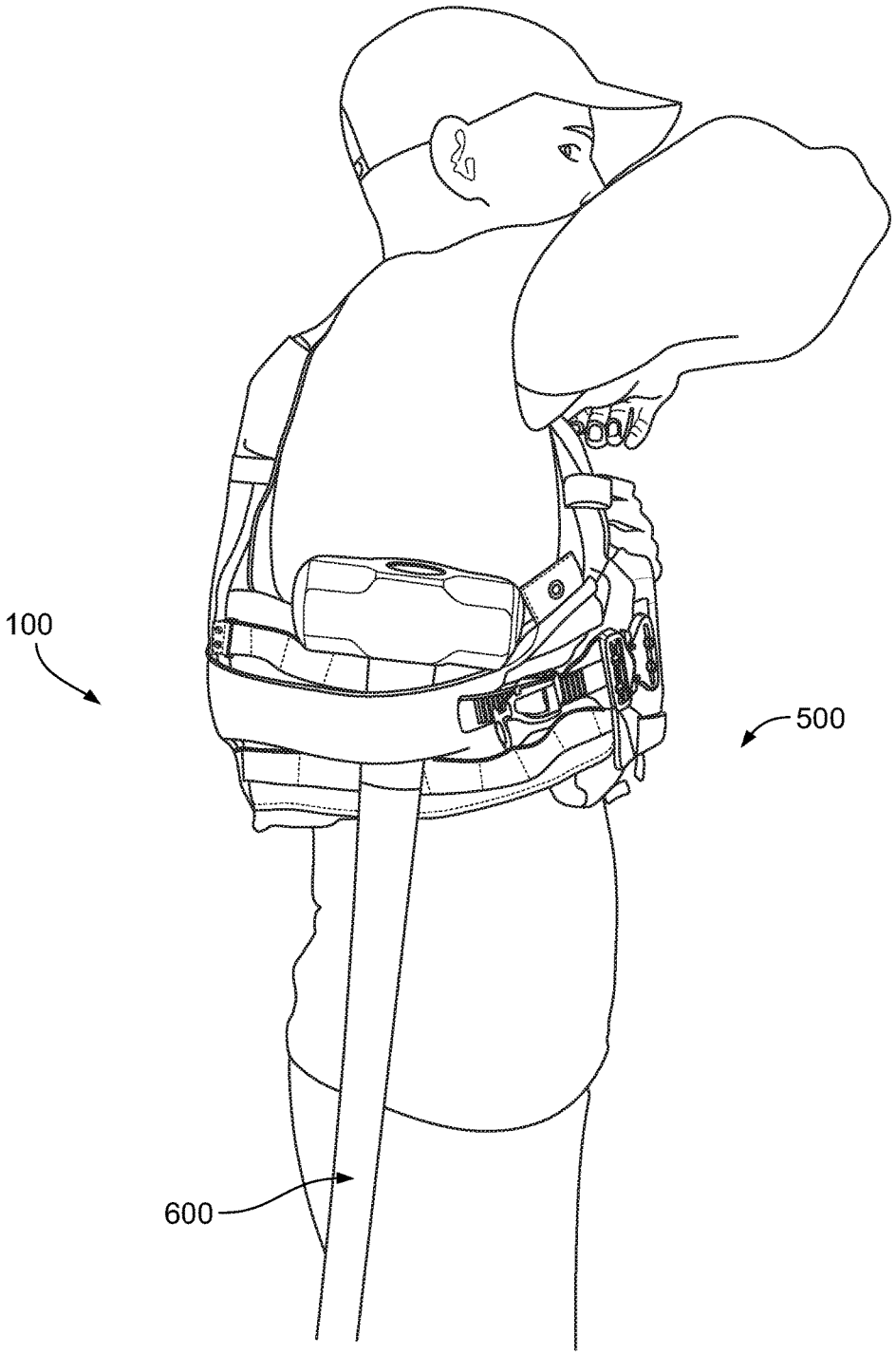

FIGS. 1-3 show various perspective views of a ballistic vest with a tool retention system according to this disclosure. FIGS. 4A-4C show a top view, a perspective top view, and a profile view of a tool retention system according to this disclosure. FIG. 9A shows a top view of a pair of first sides of a pair of tool retention systems according to this disclosure. FIG. 9B shows a top view of a pair of second sides of a pair of tool retention systems according to this disclosure.

As shown in FIG. 1, a ballistic vest 100 includes a front section 102, a back section 104 opposing the front section 102, a pair of lateral sections 110 extending between the front section 102 and the back section 104, and a pair of shoulder sections 112 extending between the front section 102 and the back section 104 such that a pair of arm openings are defined thereby. At least one of the lateral sections 110 can include a cummerbund. Note that the pair of shoulder sections 112 are spaced apart such that a neck opening is defined thereby. Each of the front section 102, the back section 104, and each of the lateral sections 110 can host an armor plate for protection from a projectile, such as a bullet or a shrapnel. The front section 102 includes a pocket 108, which may be used to store accessories, such as an ammunition magazine, a grenade, a flask, a medical kit/medical item, a firearm, a knife/blade, a radio/communication device, or any other tool. In one or more embodiments, the front section 102 includes a plurality of Modular Lightweight Load-carrying Equipment (MOLLE) straps 106 over the pocket 108. In one or more embodiments, the back section 104 includes a plurality of MOLLE straps 107, as shown in FIG. 3. Note that in one or more embodiments, each of the lateral sections 110 includes a MOLLE strap as well. In some embodiments, at least one of the shoulder sections 112 can include a MOLLE strap as well.

Note that in one or more embodiments, the ballistic vest 100 includes a body armor plate carrier, a bulletproof vest, or a bullet-resistant vest. However, other vests can be used, whether additionally or alternatively. For example, any tactical or non-tactical, ballistic or non-ballistic vest can be used. Some examples can include a vest for protection from a mechanical impact, such as a projectile, such as a bullet, a shrapnel, or a paintball, such as for law-enforcement, military, bodyguard, hunting, paintball, motorcycling, equestrian, sparring, or any other use, whether concealed or non-concealed, whether worn on humans or mammals, such as animals, such as dogs, horses, dolphins, or others. For example, any of such vests can include a reflective vest, a construction vest, a fishing vest, an inflatable vest/life jacket, or a suit vest. For example, whether additional or alternative to a vest, a suit can be used, such as a bunker gear suit, a fire proximity suit, a hazmat suit, a bomb suit, a scuba suit, a space suit, a flight suit, or any other article of clothing, vest, or suit can be used, whether decorative or specialized/functional, whether for ballistic or non-ballistic use, whether concealable or non-concealable, whether worn on humans or mammals, such as animals, such as dogs, horses, dolphins, or others.

As shown in FIG. 1, a tool retention system 200 includes a strap 206 and a ratcheting mechanism having a linear rack 208 and a pawl 210. The system 200, which may be waterproof, water-resistant, water-repellent, thermally insulating, reflective, camouflaged, non-camouflaged, or photoluminescent/phosphorescent, in whole or in part, is coupled to the vest 100. Any component of the system 200 can include plastic, fabric, leather, suede, metal, wood, rubber, glass, or other materials, whether flexible, bendable, or rigid. The system 200 can support or suspend a tool for any purpose, such as for law-enforcement, military, bodyguard, hunting, paintball, motorcycling, equestrian, sparring, hobby, recreation, medical, or any other use. Some of such tools, whether motorized or non-motorized, include a firearm, a hammer, a saw, a radio, a rocket-launcher, a stretcher, or any others for any general purpose or specialized use, as disclosed herein. In some embodiments, the lateral section 110 includes the system 200. In some embodiments, the lateral section 110 is omitted and the system 200 operates as the lateral section 110. Although the system 200 employs the ratcheting mechanism, in some embodiments, non-ratcheting mechanism may be employed, such as a hook-and-loop mechanism (on strap), a buckling mechanism (a framed prong/holes), a zipper mechanism, a nut/bolt mechanism (strap in between), a hook-and-eye mechanism (on strap) or others. The strap 206 includes a first strap end portion 201.

As shown in FIGS. 4A-4C, the strap 206 includes a first strap end portion and a second strap end portion. The first strap end portion and the second strap end portion longitudinally oppose each other. Although the strap 206 is solid, in some embodiments, the strap 206 is perforated, such as meshed. The strap 206 includes an outer side 206*a* and an inner side 206*b*, wherein the outer side 206*a* opposes the inner side 206*b*, and where the inner side 206*b* faces the lateral section 110. The strap 206 includes a pocket 232, between the outer side 206*a* and the inner side 206*b*, accessible from the outer side 206*a* between the first strap end portion and the second strap end portion. The strap 206 includes a first section 216 and a second section 218 which oppose each other when the strap 206 includes a bend 230, which in some embodiments may be hinged/pivoted. The strap 206 includes a first coupling interface 218*a* and a second coupling interface 218*b*. The first section 216 includes the first coupling interface 218*a* and the second section 218 includes the second coupling interface 218*b*. The first coupling interface 218*a* is structured to couple to the second coupling interface 218*b*, whether permanently or temporarily, such as via hook-and-looping. However, other coupling methodologies may be used, such as fastening, mating, interlocking, adhering, or others. Note that, as shown in FIGS. 9A and 9B, in some embodiments, the outer side 206*a* includes the first coupling interface 218*a* and the second coupling interface 218*b*, while in other embodiments, the inner side 206*b* includes the first coupling interface 218*a* and the second coupling interface 218*b*, and yet in other embodiments, each of the outer side 206*a* and the inner side 206*b* includes the first coupling interface 218*a* and the second coupling interface 218*b*. In some embodiments, the strap 206 includes webbing, cording, or tubing, which may be inflatable.

As shown in FIGS. 1-2, the strap 206 includes a buckling mechanism 204 coupled, whether permanently or temporarily, to a plate 202, such as via fastening, adhering, or mating thereto. The buckling mechanism 204 includes a button/lever 204*a* which elastically engages/disengages the buckling mechanism 204, such as via a spring. In one or more embodiments, the plate 202 is hosted, whether permanently or temporarily, via the MOLLE straps 106. As such, the first strap end portion is coupled to the front section 102. Alternatively, the plate 202 may be bolted, welded, sewn, glued, or coupled in any other manner to the front section 102.

As shown in FIGS. 4A-4C, the rack 208 includes a first rack end portion 205 and a second rack end portion 207. The first rack end portion 205 and the second rack end portion 207 longitudinally oppose each other. The first rack end portion 205 is coupled, whether temporarily or permanently, such as via fastening, adhering, or mating, to the first strap end portion in positional proximity of the buckling mechanism 204. The rack 208, such as via the second rack end portion 207, enters into the pocket 232 and can exit the pocket 232. The rack 208 includes a plurality of serially positioned teeth 208*a*, which are cross-sectionally triangular, longitudinally extending away from the buckling mechanism 204. Although the rack 208 is solid, in some embodiments, the rack 208 can be perforated.

As shown in FIGS. 4A-4C, the pawl 210 includes a circumferentially toothed wheel 210*a*, which rotationally meshes with the teeth 208*a* such that the pawl 210 engages the rack 208. The pawl 210 includes a T-shaped tab 212 coupled thereto, whether permanently or temporarily, such as via fastening, mating, adhering, or other coupling ways. As such, the tab 212 is structured to cause the pawl 210 to engage the rack 208 towards the first strap end portion away from the second strap end portion, such as when the tab 210 is pulled away from the rack 208. The pawl 210 includes a button 214, which is elastically biased thereto. The button 214 enables a release of the pawl 210 from the rack 208, such as for readjustment. The pawl 210 is coupled to the strap 206 at a strap point 206*c* on the strap 206 between the first strap end portion and the second strap end portion. For example, the pawl 210 can be attached or secured to the strap 206, whether permanently or temporarily, via fastening, mating, adhering, or others coupling ways. As such, the button 214 is structured to cause the pawl 210 to disengage the rack 208 away from the first strap end portion towards the second strap end portion, such as when the button is activated.

As shown in FIGS. 4A-4C, when the tab 212 is activated, which may be repeatedly, including in a quick succession, such as via pulling/pivoting or pushing/pivoting, such as manually, the pawl 210, such as via a wheel 210*a*, engages the rack 208. Note that each of such activations may engage, such as via advancing, the pawl 210 by at least one tooth/position 208*a* on the rack 208. For example, two or three or even more teeth/positions are possible and can be user adjustable, whether more or less. Further, note that since the pawl 210 is coupled to the strap 206 at the strap point 206*c*, such as via being positionally fixed thereto, the pawl 210 remains stationary with respect to the second strap end portion and the rack 208 moves towards the second strap end portion and towards and/or into the pocket 232, which may include entry, or further entry, into the pocket 232, away from the first strap end portion and the buckling mechanism 204.

Likewise, as shown in FIGS. 4A-4C, when the button 214 is activated, which may be repeatedly, including in quick succession, such as via pulling/pivoting or pushing/pivoting, such as manually, the pawl 210, such as via the wheel 210*a*, disengages the rack 208. Note that each of such activations may disengage, such as via disadvancing, the pawl 210 by at least one tooth/position 208*a* on the rack 208. For example, two or three or even more teeth/positions are possible and can be user adjustable, whether more or less. Further, note that since the pawl 210 is coupled to the strap 206 at the strap point 206*c*, such as via being positionally fixed thereto, the pawl 210 remains stationary with respect to the second strap end portion and the rack 208 moves away from the pocket 232, which may include exit, or further exit, from the pocket 232, toward the first strap end portion and the buckling mechanism 204.

As such, as shown in FIGS. 4A-4C, since the pawl 210 is coupled to the strap 206 between the first strap end portion and the second strap end portion, a linear distance between the pawl 210 and the first strap end portion decreases as the pawl 210 engages the rack 208 towards the buckling mechanism 204, away from the second rack end portion, towards the first rack end portion, as the rack 208 enters, or further enters the pocket 232. Further, note that a form-changing strap portion of the strap 206 is positioned between the first strap end portion and the strap point 206*c*, and between the buckling mechanism 204 and the strap point 206*c*. Consequently, as the linear distance decreases, the form-changing strap portion, such as due to pressure from the pawl 210, bends or flexes or otherwise form a curved shape between the strap point and the first strap end portion/buckling mechanism 204.

Correspondingly, as shown in FIGS. 4A-4C, the linear distance between the pawl 210 and the first strap end portion is increased as the pawl 210 disengages the rack 208 away from the buckling mechanism 204, towards the second rack end portion, away from the first rack end portion, as the rack exits or further exits the pocket 232. Consequently, as the linear distance increases, the form-changing strap portion, such as due to lack of pressure from the pawl 210, unbends or straightens or otherwise forms a relatively non-curved, minimally curved or less curved shape between the strap point and the first strap end portion/the buckling mechanism 204. For example, the non-concave shape can be rectilinear or sinusoidal. In some embodiments, the rack 208 avoids entry or exit from the pocket 232.

As shown in FIG. 3, the strap 206 includes a slide adjuster 226 insertably mounted thereonto, in proximity of the bend 230, between the first strap end portion and the second strap end portion. The slide adjuster 226 is coupled to a plate 222, whether permanently or temporarily, via a fragment 228 looping through the slide adjuster 226 and coupled to the plate 222 via a pair of screws 224 at both ends of the fragment 228. However, note that other ways of coupling the slide adjuster 226 to the plate 222 are possible, such as mating, interlocking, adhering, or others. The plate 222 is hosted via the MOLLE straps 107. Alternatively, the plate 222 may be bolted, welded, sewn, glued, or coupled in any other manner to the rear section 104. The strap 206 includes a second strap end portion 203.

Figure 5:
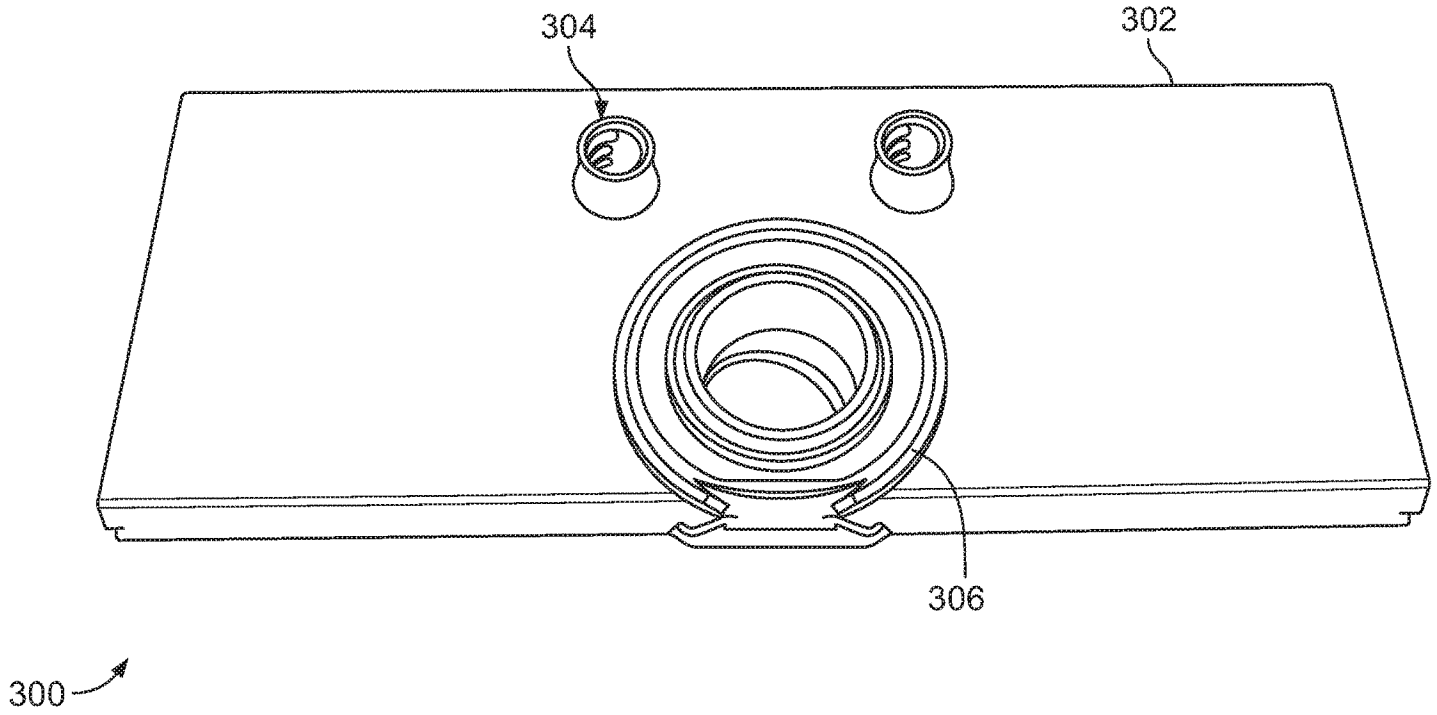
FIG. 5 shows a perspective top view of an anchor according to this disclosure.

FIG. 5 shows a perspective top view of an anchor according to this disclosure. An anchor 300 includes a plate 302, a plurality of channels 304, and a grommet 306. The plate 302 hosts the channels 304 and the grommet 306. The plate 302 can include metal, plastic, wood, rubber, fabric, or other materials. The plate 302 can be rigid or flexible. The channels 304 are tubular and inserted through the plate 302 and can include metal, plastic, wood, rubber, fabric, or other materials. However, the channels 304 can also be bored through the plate 302. The channels 304 can be internally threaded, such as for screws/bolts or smooth. The grommet 306 can be internally threaded. Although the grommet 306 is positioned such that a portion thereof is at an edge of the plate 302, other positions are possible, such as medial to the plate 302. As shown in FIG. 3, the anchor 300 can couple to the fragment 228 via the screws 224 such that the strap 206 is coupled to the back section 104.

Figure 6:
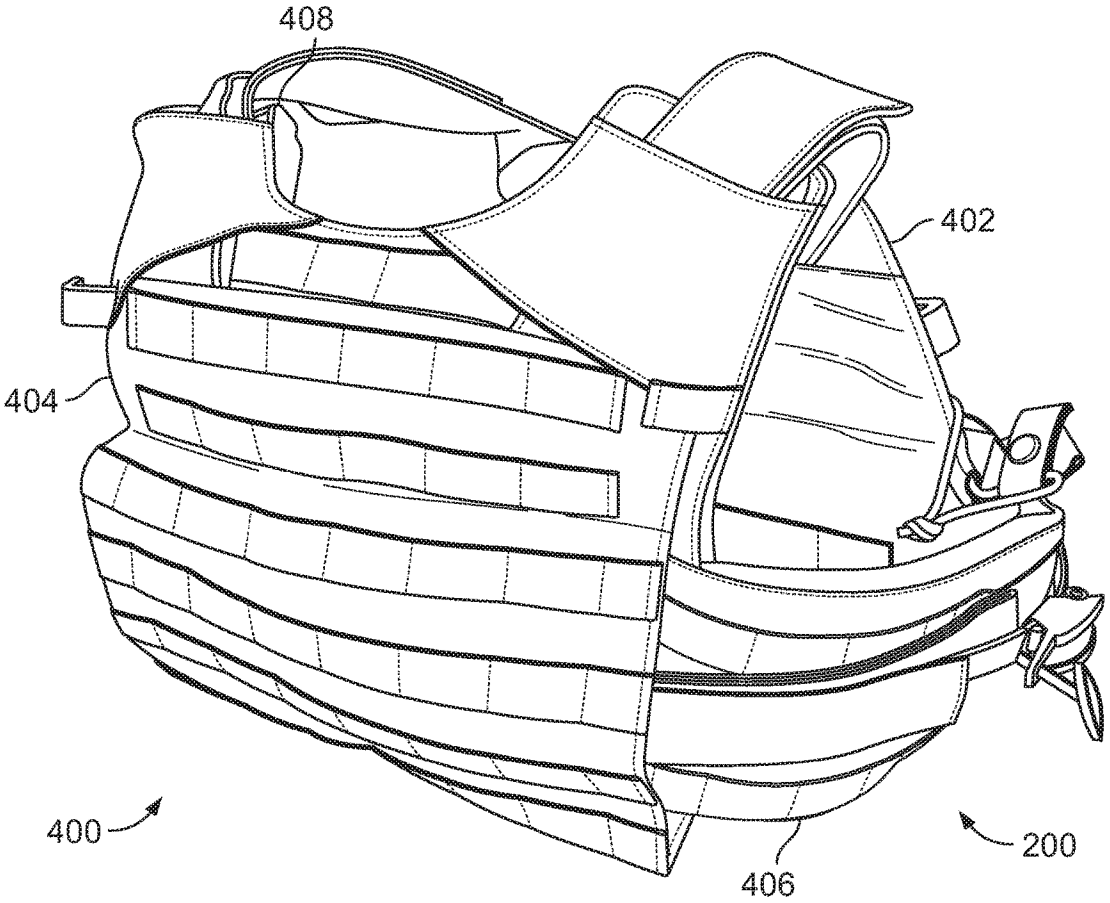
FIG. 6 shows a perspective back view of a ballistic vest with a cord and a tool retention system according to this disclosure.
Figure 7:
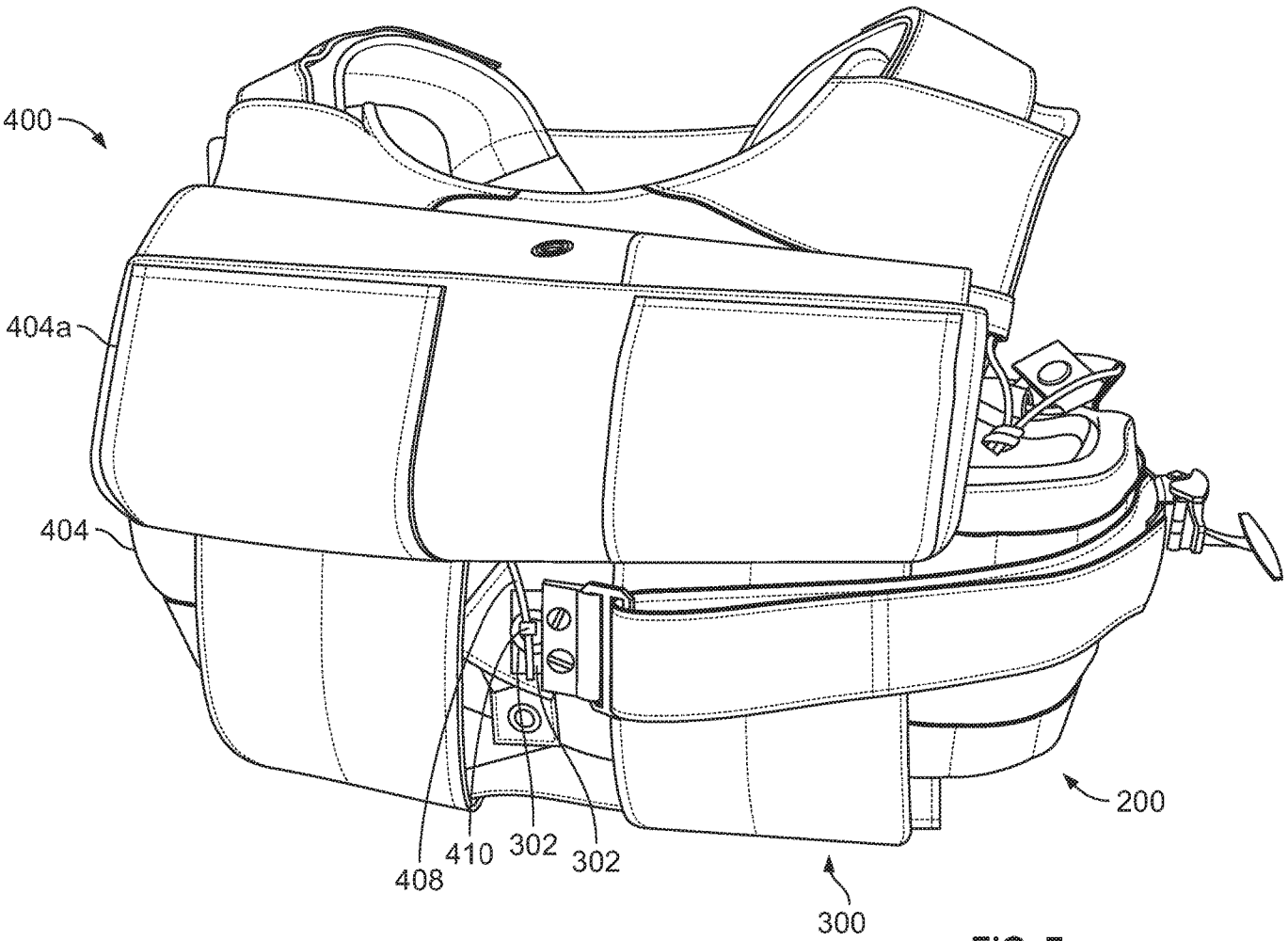
FIG. 7 shows a perspective back view of a ballistic vest with a cord and a tool retention system, where the ballistic vest includes a back flap unfolded according to this disclosure.
Figure 8:
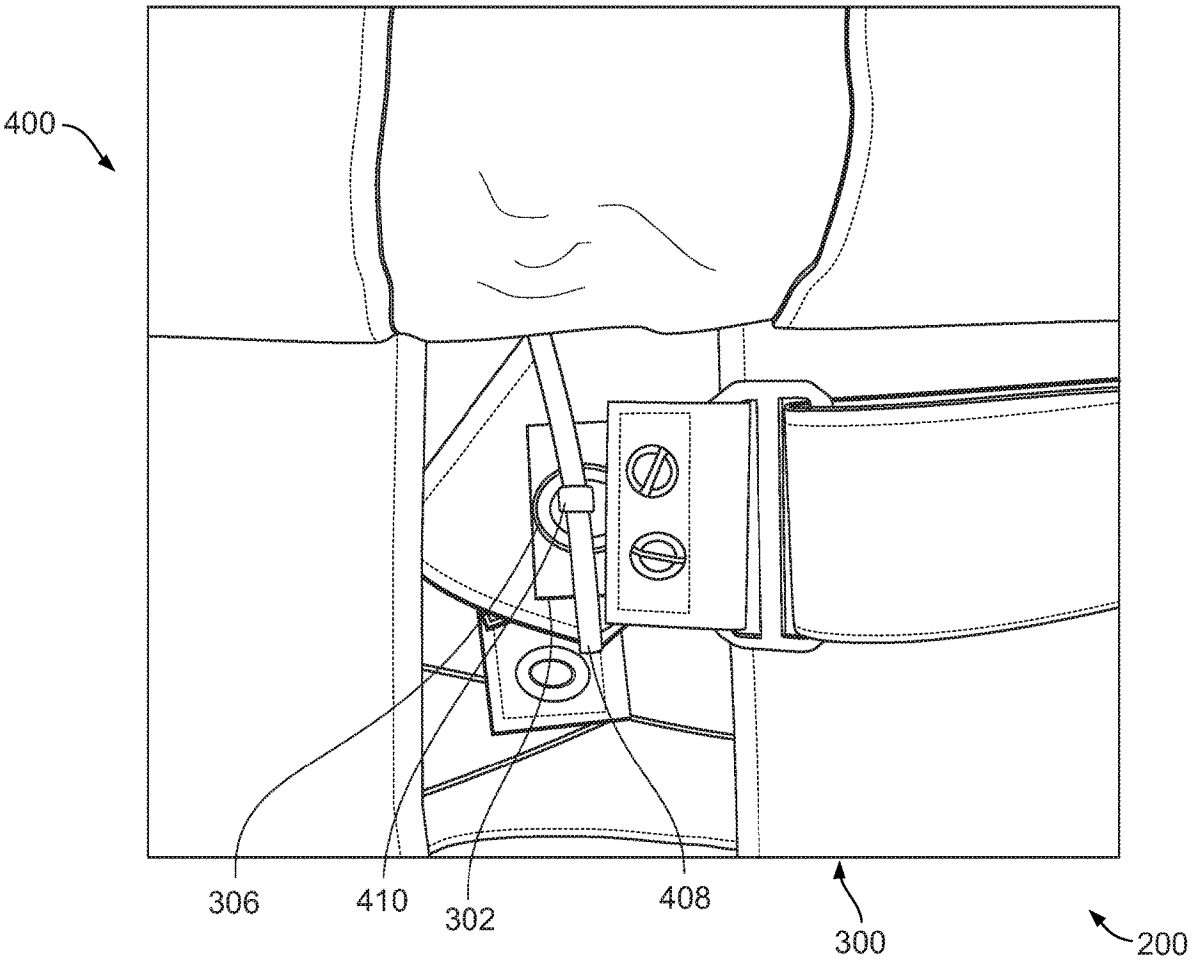
FIG. 8 shows a close-up perspective back view of a ballistic vest with a cord, a loop, and a strap, where the cord extends through the loop to secure the strap to the ballistic vest according to this disclosure.

FIG. 6 shows a perspective back view of a ballistic vest with a cord and a tool retention system according to this disclosure. FIG. 7 shows a perspective back view of a ballistic vest with a cord and a tool retention system, where the ballistic vest includes a back flap unfolded according to this disclosure. FIG. 8 shows a close-up perspective back view of a ballistic vest with a cord, a loop, and a strap, where the cord extends through the loop to secure the strap to the ballistic vest according to this disclosure.

As shown in FIGS. 6-8, a ballistic vest 400 can include a front section 402, a back section 404, a pair of lateral sections 406, a pair of shoulder sections 412, a cord 408, and a loop 410. The cord 408 can include plastic, metal, fabric, rubber, wood, or other materials. The cord 408 can include a rope, a string, a chain, a cable, a belt, or other elongated structures. The cord 408 can be solid or perforated. The loop 410 can include plastic, metal, fabric, rubber, wood, or other materials. The loop 410 can be of any closed or substantially closed shape, whether flexible or rigid, such as circular, oval, or others. The loop 410 can be solid or perforated.

As shown in FIG. 7, the back section 404 includes a flap **404*a* and the loop 410. The lateral sections 406 extend between the front section 402 and the back section 404. At least one of the lateral sections 406 can include a cummerbund. The shoulder sections 412 extend between the front section 402 and the back section 404. The flap 404*a* covers the loop 410 when the flap 404*a* is deployed, such as to minimize access thereto, such as during combat, and uncovers the loop 410 when the flap 404*a* is undeployed, such as to maximize access thereto, such as when maintaining the vest 400. As shown in FIG. 6, the cord 408 extends from at least one of the shoulder sections 412 through the back section 404 and then through the loop 410 such that the vest 400 is unsecured from a user thereof when the cord 408 is pulled from at least one of the shoulder sections 412. Alternatively, the cord 408 can extend from any location on the vest accessible and within reach of a user such that the user can pull the cord during an event that requires a release of the vest 100. As such, since the strap 206 is coupled to the back section 404, such as via the slide adjuster 226, the strap 206 may be released at that point at least from the back section 404**.

One way this functionality may be accomplished is via the anchor 300, as shown in FIG. 5, interfacing with the strap 206 via the slide adjuster 226, as shown in FIG. 8. For example, the slide adjuster 226 is coupled to the fragment 228 via the fragment 228 looping through the slide adjuster 226, as the slide adjuster 226 is mounted onto the strap 206 between the first strap end portion and the second strap end portion, and then having both ends of the fragment 228 secured to the plate 302, such as via the pair of screws 224, although other securing methods are possible, such as fastening, mating, interlocking, adhering, or others.

As shown in FIGS. 6-7, at least one of the shoulder sections 412 routes the cord 408 therethrough or thereon, whether visible or invisible, whether secured thereto or freely, yet such that a frontal end or some other portion of the cord 408 is user-accessible from the front section 402, such as via manual pulling away from the vest 400. As shown in FIG. 8, the cord 408 is further routed through the back section 404, which may or may not avoid the flap **404*a*, and toward an area of the back section 404 having the loop 410. In that area, both end portions of the shoulder sections 412, each of which has a bore therethrough, are positioned such that the loop 410 serially extends through those bores as those bores co-align for fluid communication therethrough. Likewise, both end portions of the lateral sections 406, each of which has a bore therethrough, are positioned such that the loop 410 serially extends through those bores as those bores also co-align for fluid communication therethrough. In some embodiments, the shoulder sections 412 and the lateral sections 406** alternate between each other.

As shown in FIG. 8, the anchor 300 is positioned such that the loop 410 extends through the grommet 306, after extending through the bores of the shoulder sections 412 and the lateral sections 406, before the vest 400 is unsecured from the user and then the cord 408 extends through the loop 410 over the grommet 306. At least due to resulting outward pressure exerted onto the loop 410 via the shoulder sections 412, the lateral sections 406, and the grommet 306, the vest 400 may be at least partially secured to the user. In some embodiments, the end portions, with the bores, of the lateral sections 406 are interposed between the end portions, with the bores, of the shoulder section 412 and the plate 302 with the grommet 306. In some embodiments, this order may be different, where the end portions, with the bores, of the shoulder section 412 are interposed between the end portions, with the bores, of the lateral sections 406 and the plate 302 with the grommet 306. In some embodiments, a pair of cords 408 is used, where the cords 408 are routed through the shoulder sections 412 in a one-to-one manner, i.e., one cord 408 to one shoulder section 412. In some embodiments, one of the end portions of one of the shoulder sections 412 includes a plurality of bores, which may be grommeted, positioned longitudinally on that end portion, such as rectilinear or sinusoidal, such as in order to accommodate various shoulder section sizes. In some embodiments, one of the end portions of one of the lateral sections 406 includes a plurality of bores, which may be grommeted, positioned longitudinally on that end portion, such as rectilinear or sinusoidal, such as in order to accommodate various lateral sizes.

FIG. 9A shows a top view of a pair of first sides of a pair of tool retention systems according to this disclosure. FIG. 9B shows a top view of a pair of second sides of a pair of tool retention systems according to this disclosure. A pair of tool retention systems are shown, where such pair includes the system 200 and a system 500. Although the system 200 and the system 500 are generally similar, there are various differences between the system 200 and the system 500.

For example, as shown in FIG. 9A, the system 200 includes the outer side 206*a* that hosts the first coupling interface 218*a* and the second coupling interface 218*b*. In contrast, the system 500 includes a strap 504 having an outer side 504*a* and an inner side 504*b*, where the outer side 504*a* and the inner side 504 oppose each other, and the outer side 504*a* lacks a pair of such similar coupling interfaces, as included in 218*a*. Further, the outer side 206*a* is colored with a solid color, such as black, although other colors, color combinations or patterns are possible. In contrast, the outer side 504*a* is colored with a camouflaged pattern, such as green, mustard, and brown, although other colors, color combinations, or patterns are possible. Further, the system 200 employs the slide adjuster 226 for coupling the strap 206 to the back section 104 of the vest 100, such as via the fragment 228 looping through the slide adjuster 226 and being coupled to the anchor 300. In contrast, the system 500 employs a plated slide adjuster for coupling to the MOLLE straps 107 of the back section 104 of the vest 100. Note that this plated slide adjuster includes a pair of bores, which may be threaded. Further, note that a buckling mechanism of the system 500 employs a set of screws/bolts 502 for securing to a plate for hosting in the MOLLE straps 106, although other securing methodologies may be used, such as mating, interlocking, adhering, or others. Further, when viewed from above, and the straps 206, 504 fully extended, the anchor 300 is not visible, as the anchor 300 is located on the inner side 206*b*, in the system 200, whereas the plated slide adjuster is visible, as plated slide adjuster is located on the outer side 504*a*, in the system 500.

For example, as shown in FIG. 9B, the inner side 504*b* includes a first coupling interface 506*a* and a second coupling interface 506*b*. The first coupling interface 506*a* is structured to couple to the second coupling interface 506*b*, whether permanently or temporarily, such as via hook-and-looping. However, other coupling methodologies may be used, such as fastening, mating, interlocking, adhering, or others. In contrast, the inner side 206*b* lacks a pair of such similar coupling interfaces. Further, the inner side 206*b* is colored with a solid color, such as black, although other colors or color combinations are possible. In contrast, the inner side 504*b* is colored with a camouflaged pattern, such as green, mustard, and brown, although other colors, color combination, or patterns are possible. Further, when viewed from above, the anchor 300 is visible in the system 200, whereas the plated slide adjuster is partially hidden in the system 500.

FIGS. 10A-10D show various views of a user wearing a ballistic vest with a tool retention system supporting a tool according to this disclosure. The user is wearing the vest 100 with the system 500 carrying a tool 600, whether an automatic rifle or a sledgehammer. However, as noted above, the tool 600 is not limited thereto and the tool 600 can be any tool for any purpose, such as for law-enforcement, military, bodyguard, hunting, paintball, motorcycling, equestrian, sparring, hobby, recreation, medical, or any other use. Some of such tools, whether motorized or non-motorized, include a firearm, a hammer, a saw, a radio, a rocket-launcher, a stretcher, or any others for any general purpose or specialized use, as disclosed herein.

Figure 11A:
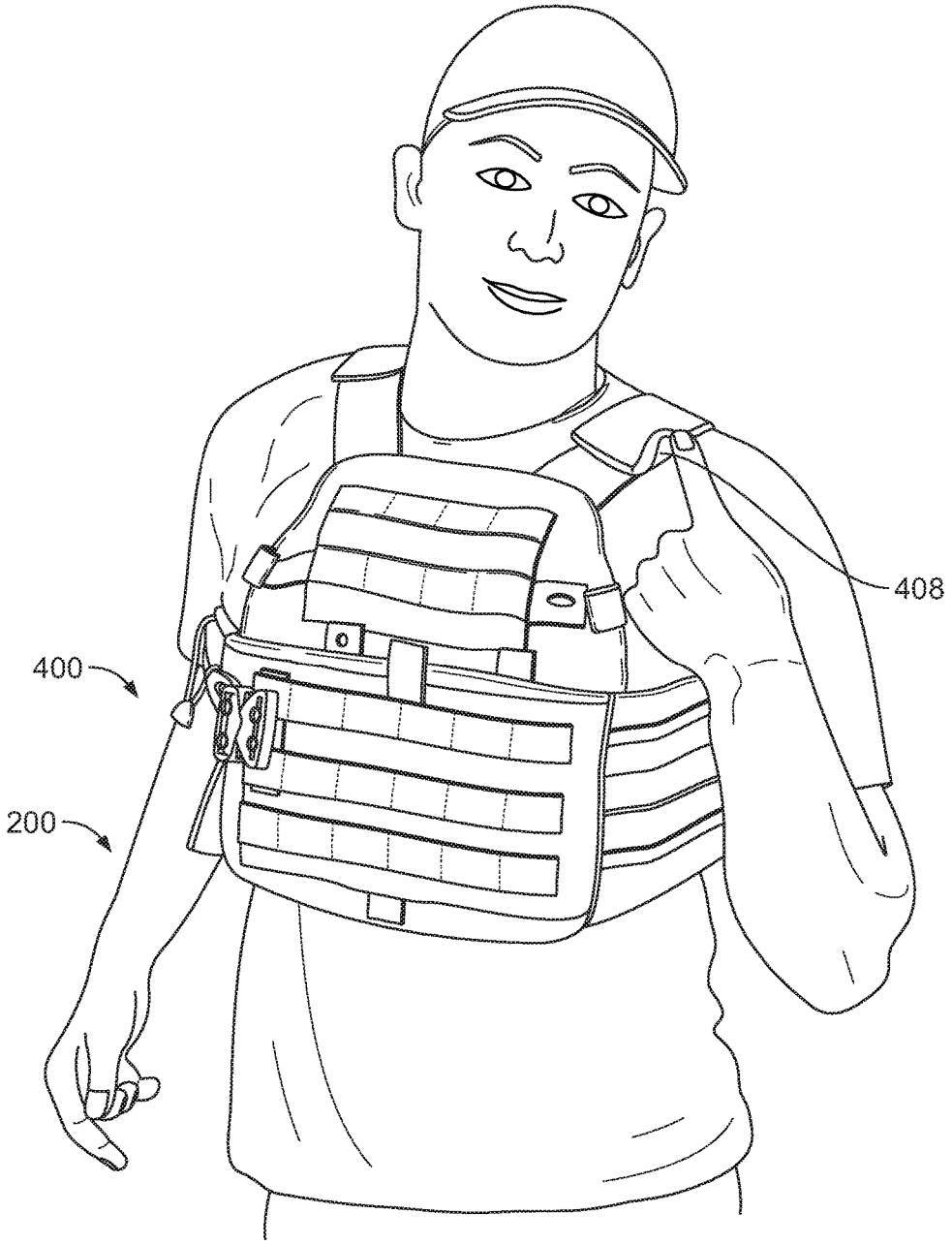
FIGS. 11A-11B show a user pulling a cord of a ballistic vest such that the ballistic vest freely drops from the user according to this disclosure.
Figure 11B:
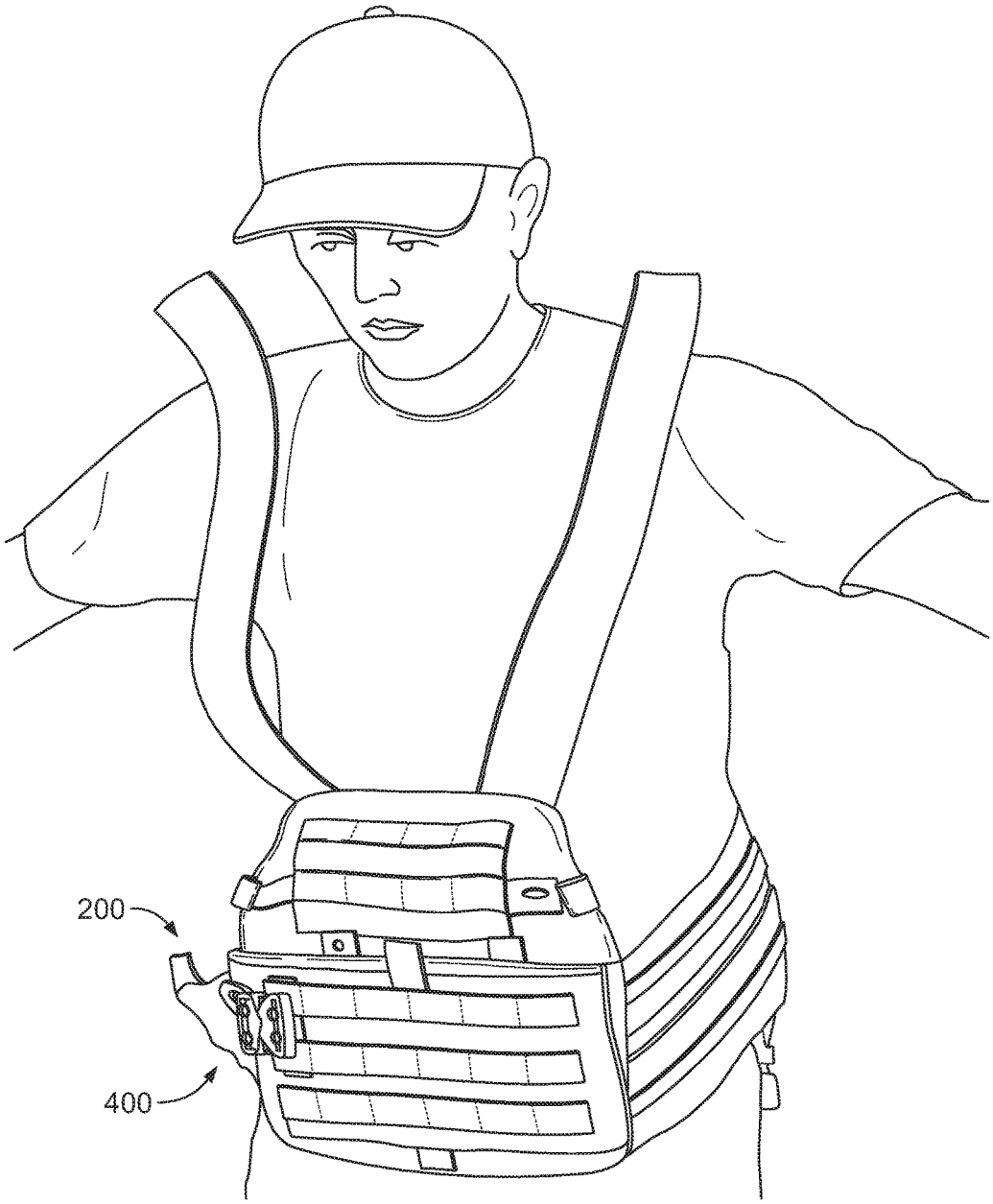

FIGS. 11A-11B show a user pulling a cord of a ballistic vest such that the ballistic vest freely drops from the user according to this disclosure. When the user of the vest 400 pulls the cord 408 from the shoulder section 412 away from the vest 400, then the vest 400 gravitationally slips off or falls off the user. This may be useful when the user is situated in a body of water and in order to maximize mobility the user desires to detach from the vest 400.

Figure 12A:
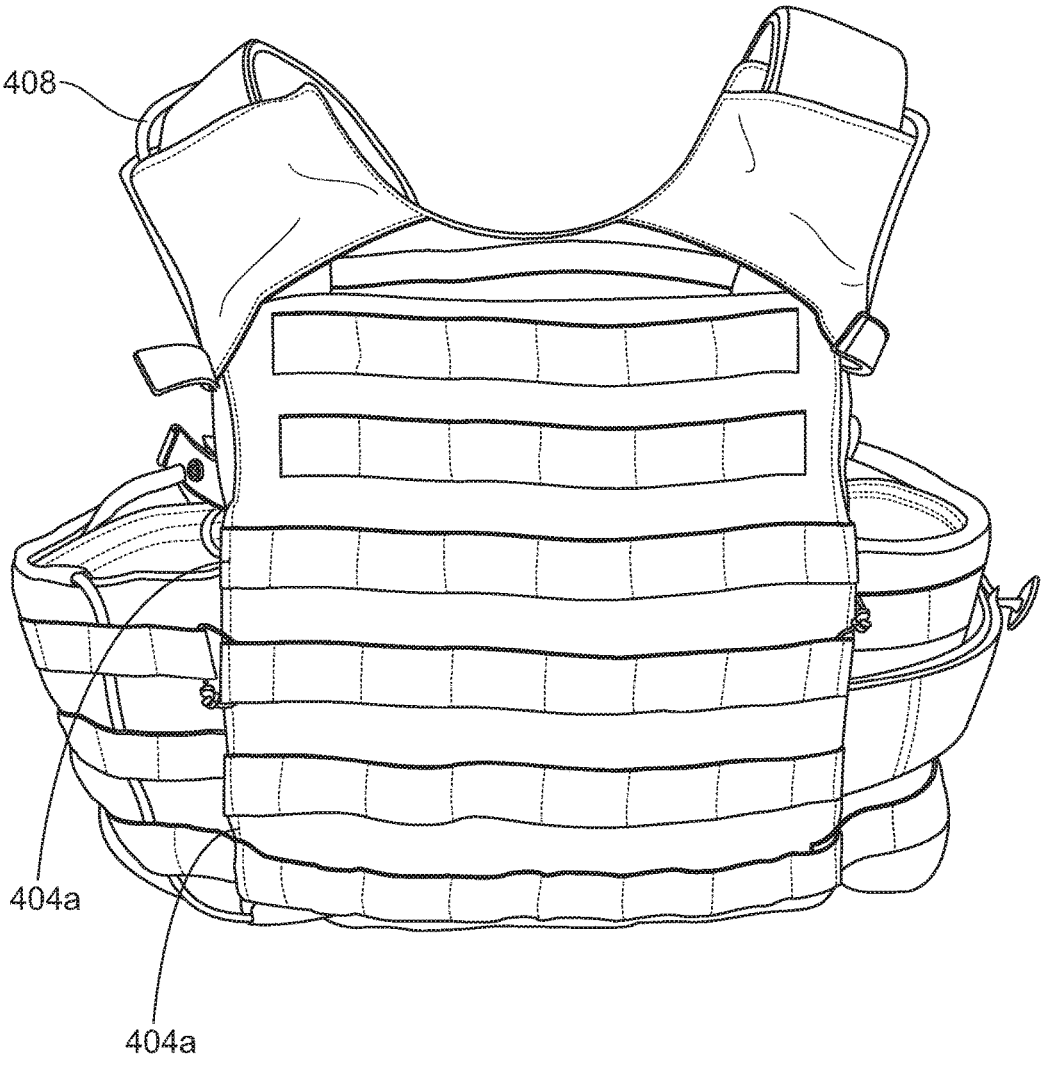
FIGS. 12A-12E show various close-up views of a cord being pulled from a loop of a ballistic vest according to this disclosure.
Figure 12B:
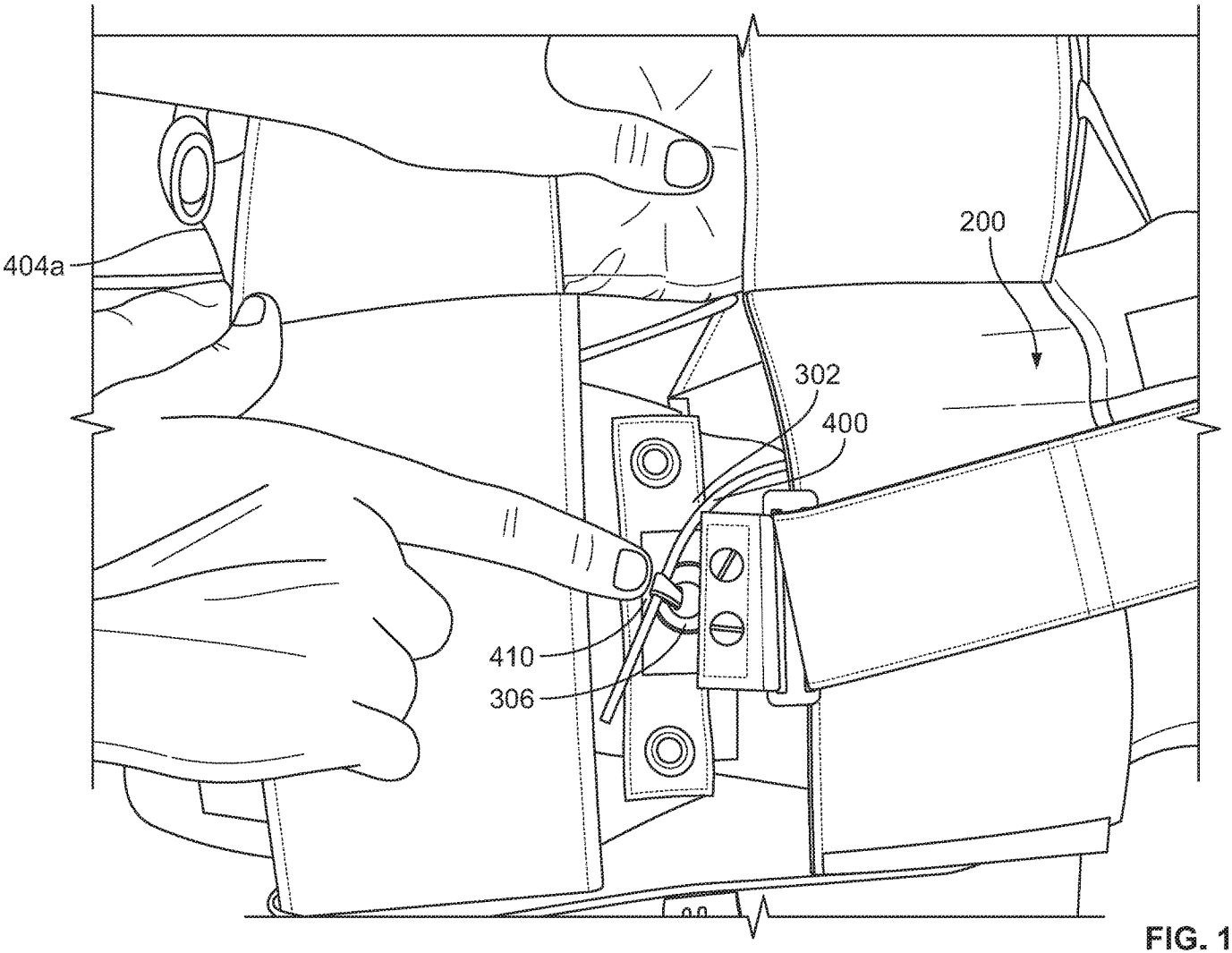
Figure 12C:
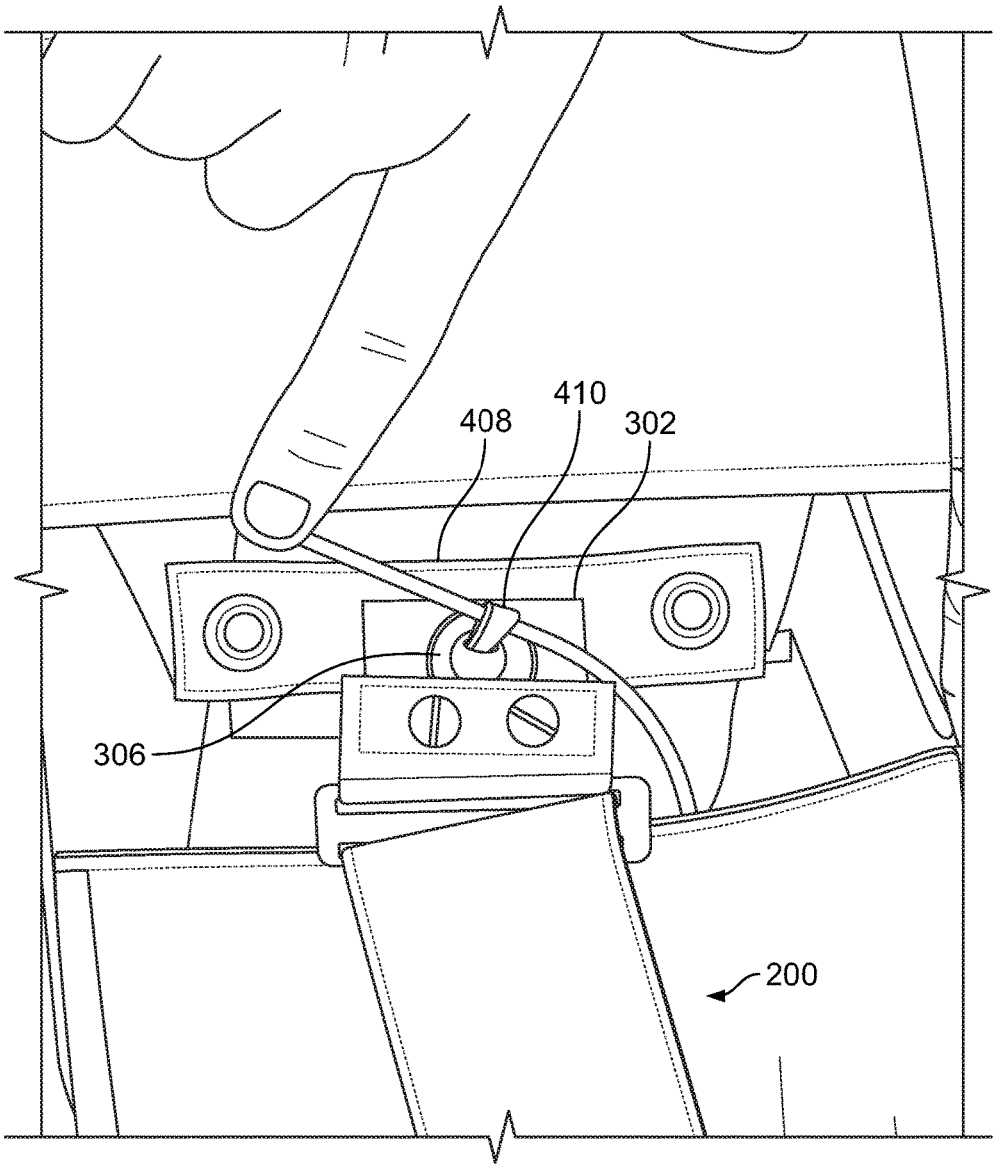
Figure 12D:
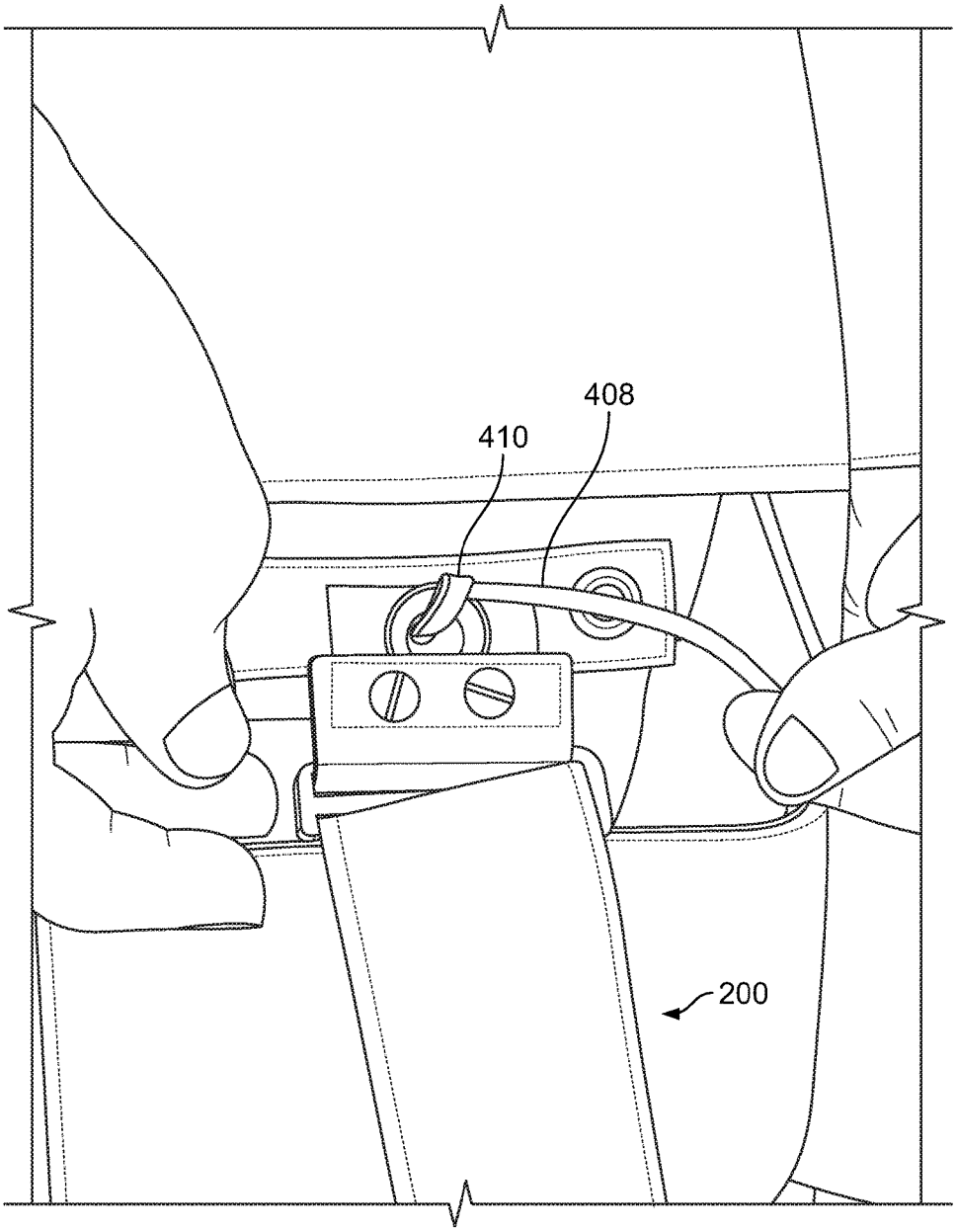
Figure 12E:
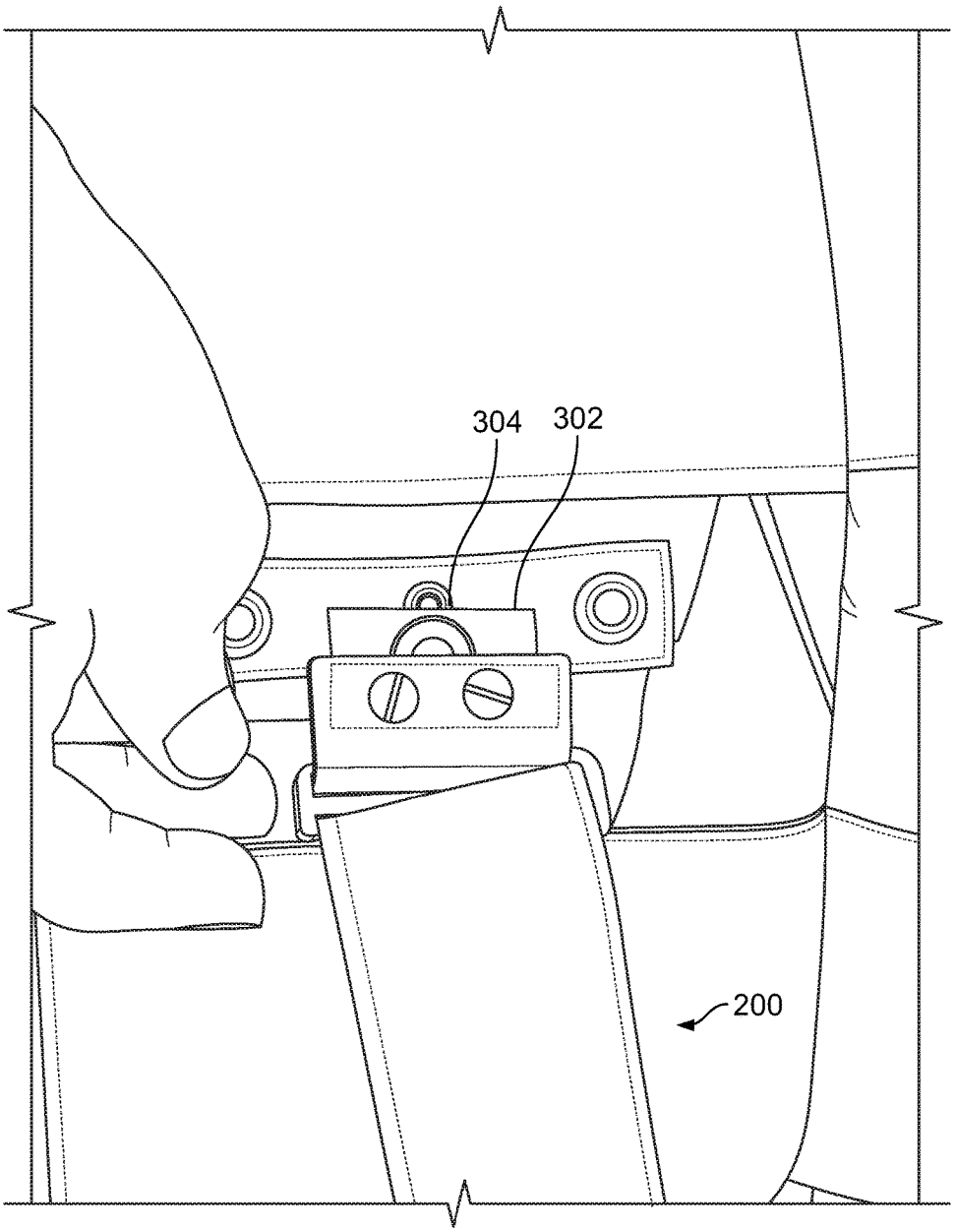

FIGS. 12A-12E show various close-up views of a cord being pulled from a loop of a ballistic vest according to this disclosure. FIG. 12A shows the flap 404*a* lowered such that the loop 410 is covered. FIGS. 12B and 12C show the flap 404*a* raised such that the loop 410 with the cord 408 extending therethrough are exposed. FIG. 12D shows the cord 408 being pulled out of the loop 410. FIG. 12E shows the cord 408 being fully pulled out of the loop 410 such that the anchor 300 is unsecured from the vest 400.

Figure 13A:
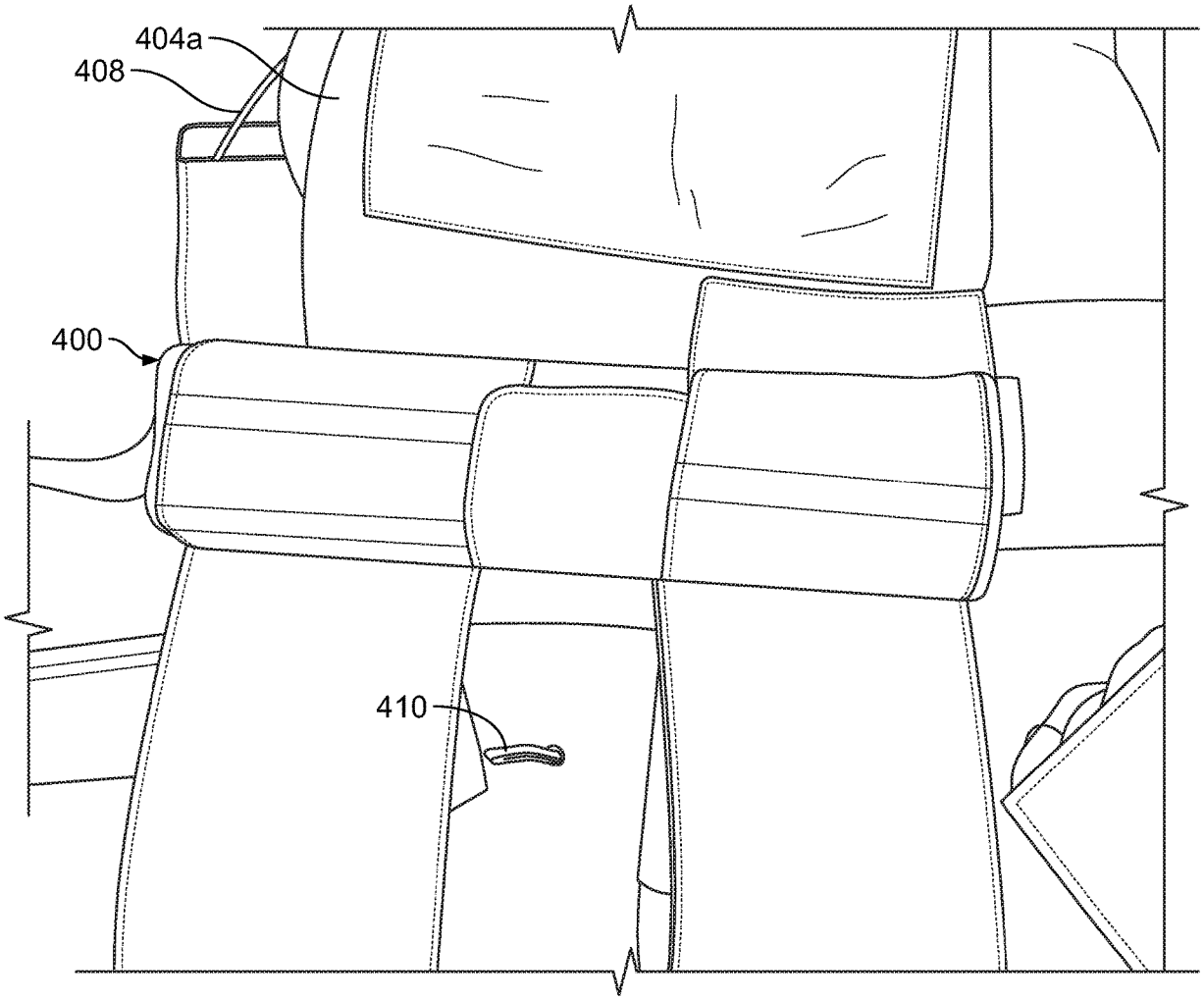
FIGS. 13A-13G show various close-up views of a cord being inserted into a loop of a ballistic vest according to this disclosure.
Figure 13B:
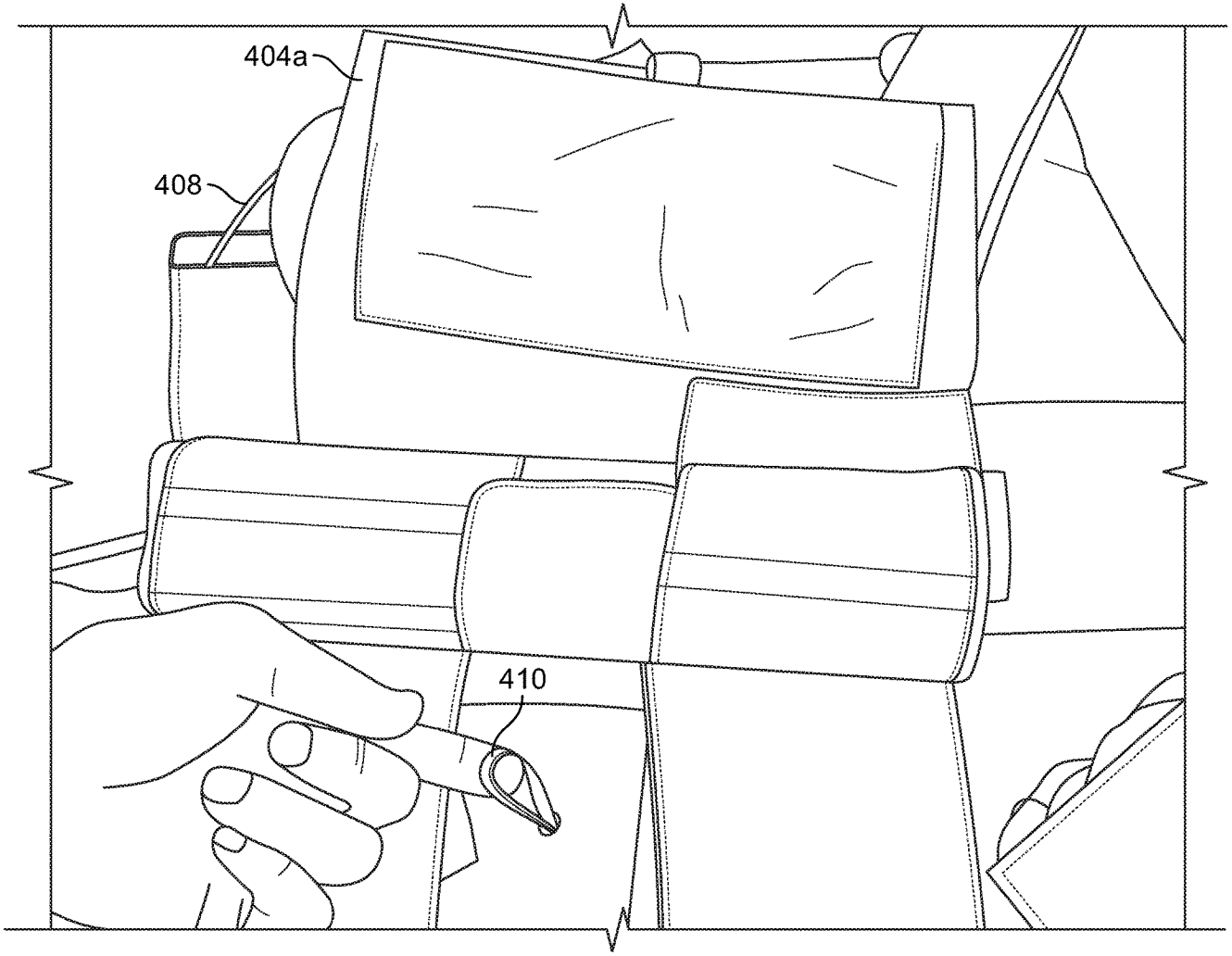
Figure 13C:
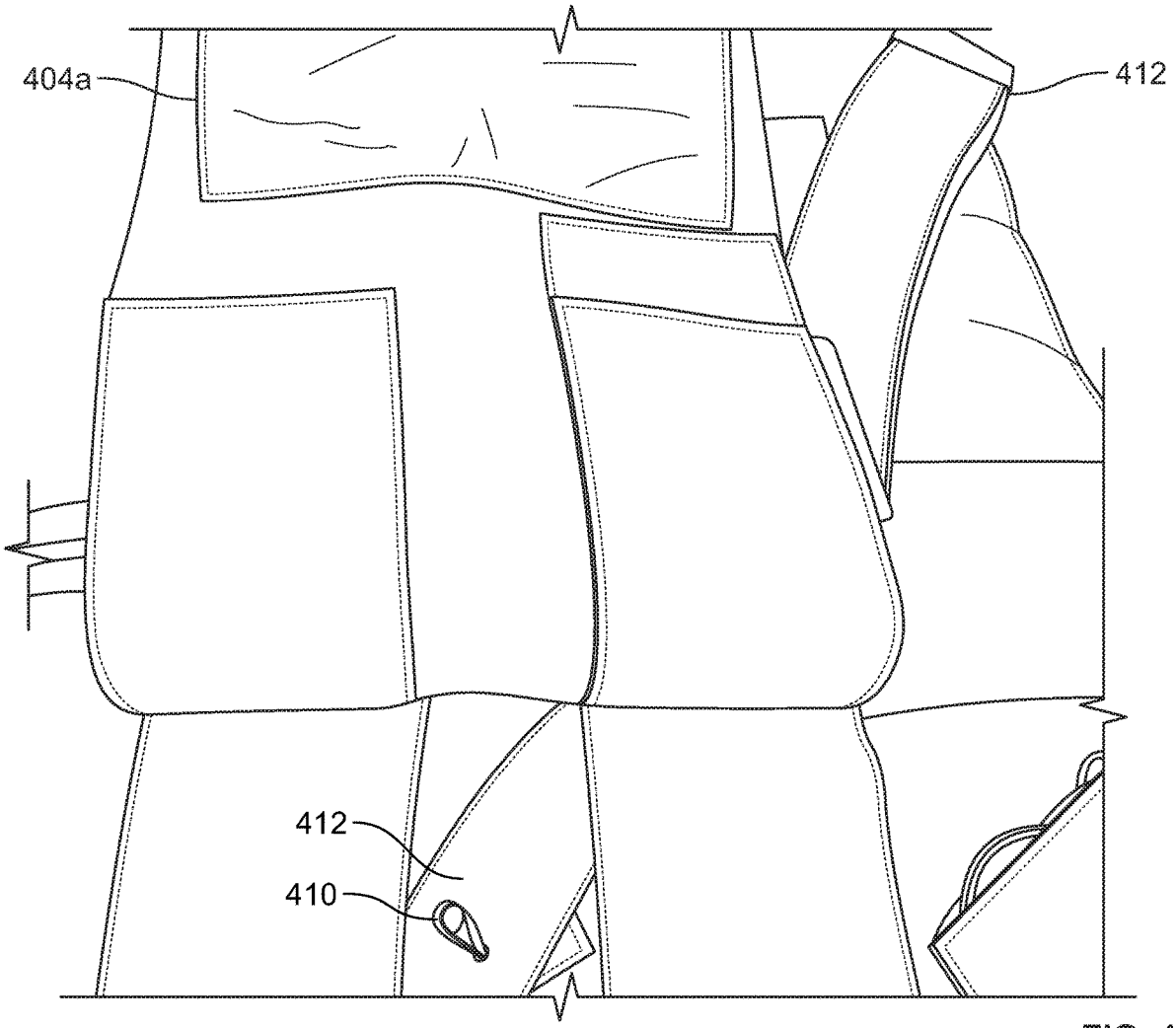
Figure 13D:
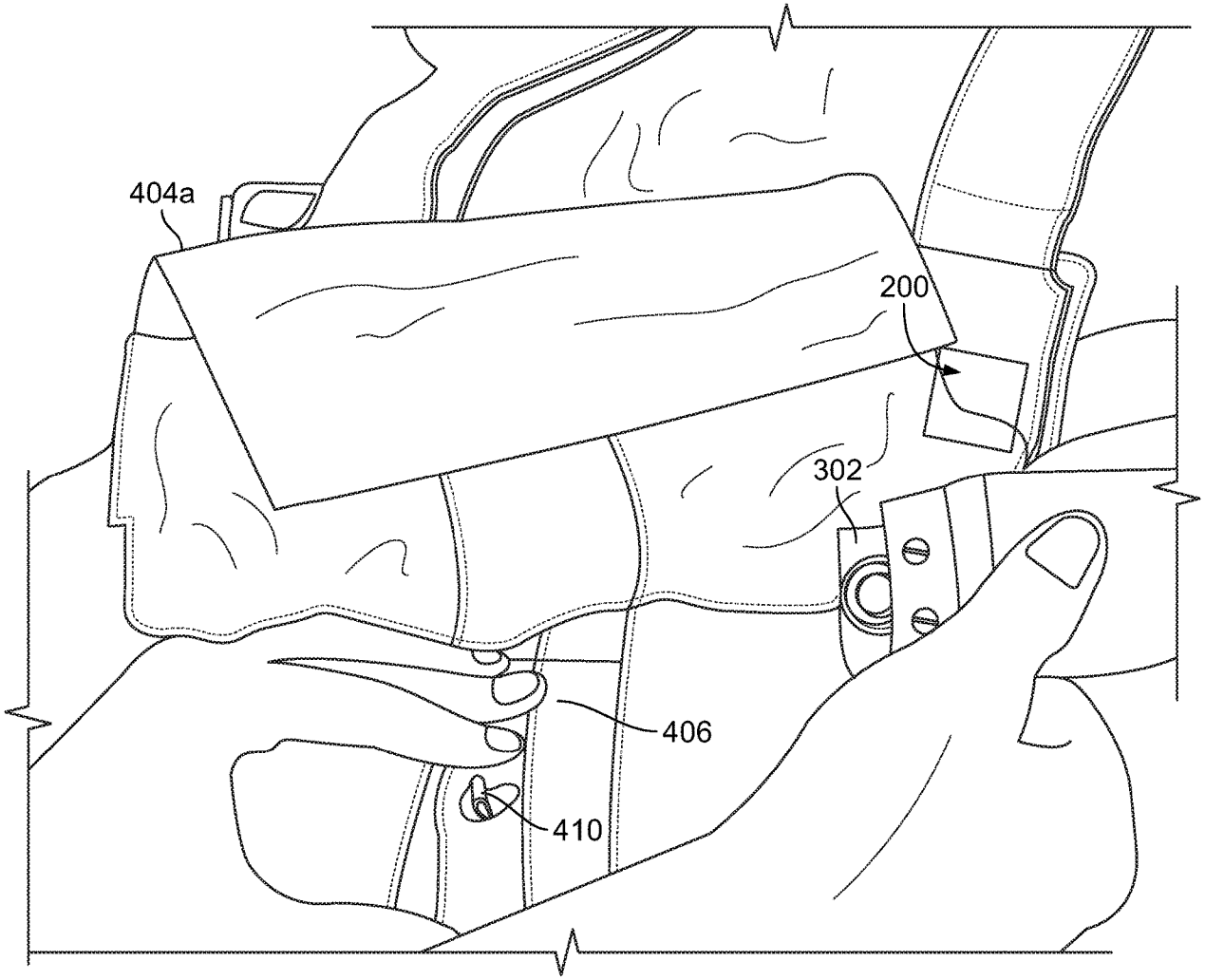
Figure 13E:
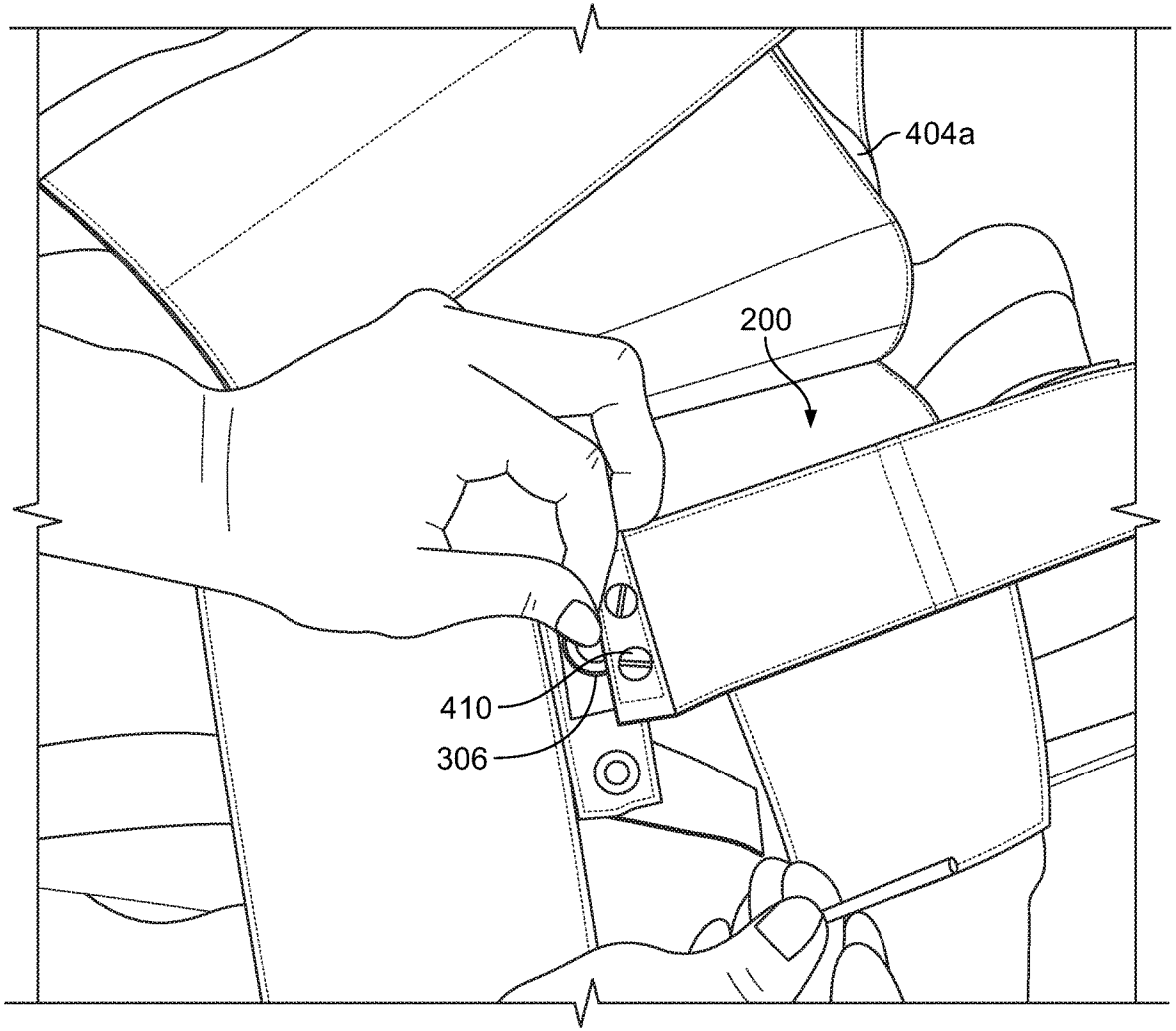
Figure 13F:
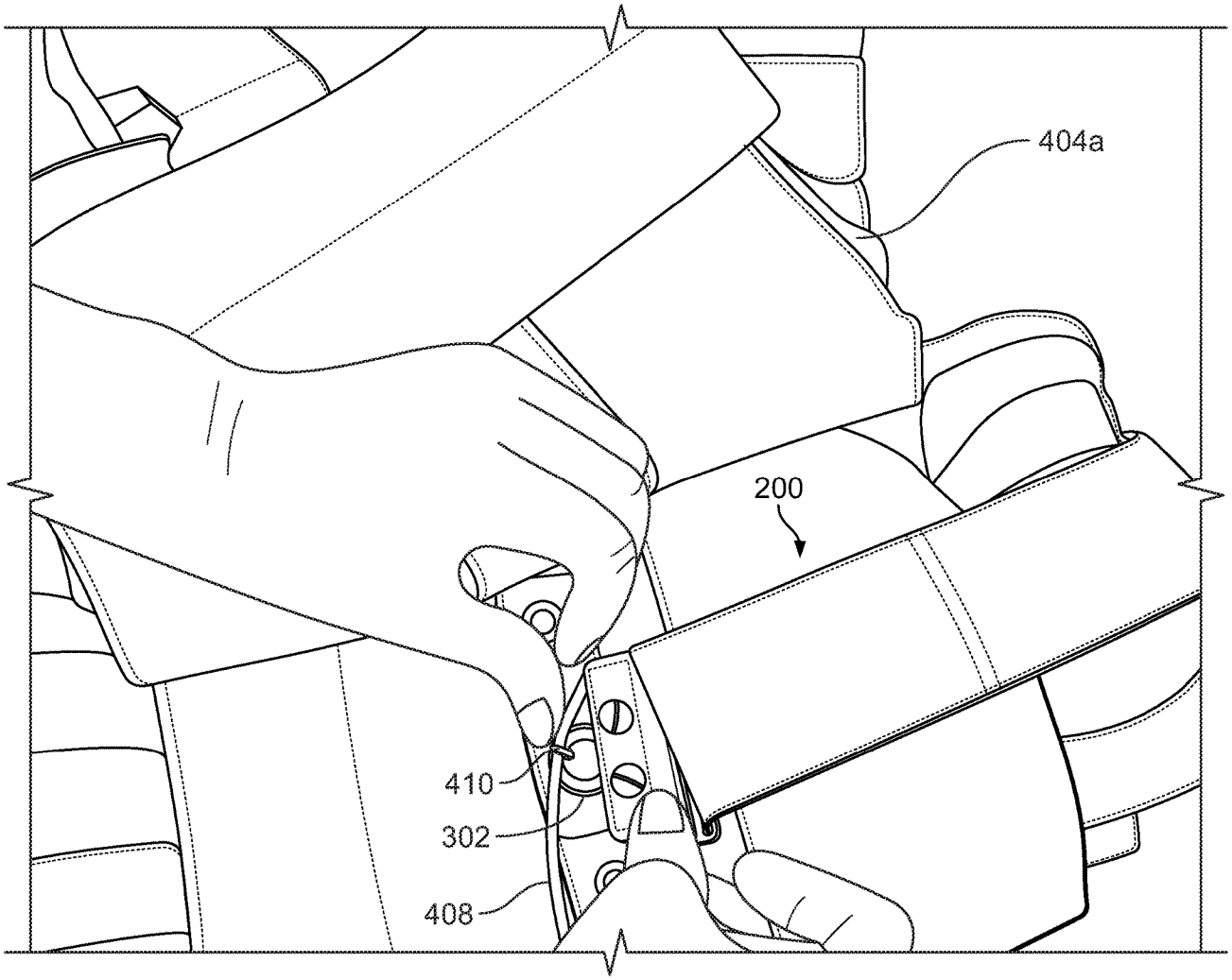
Figure 13G:
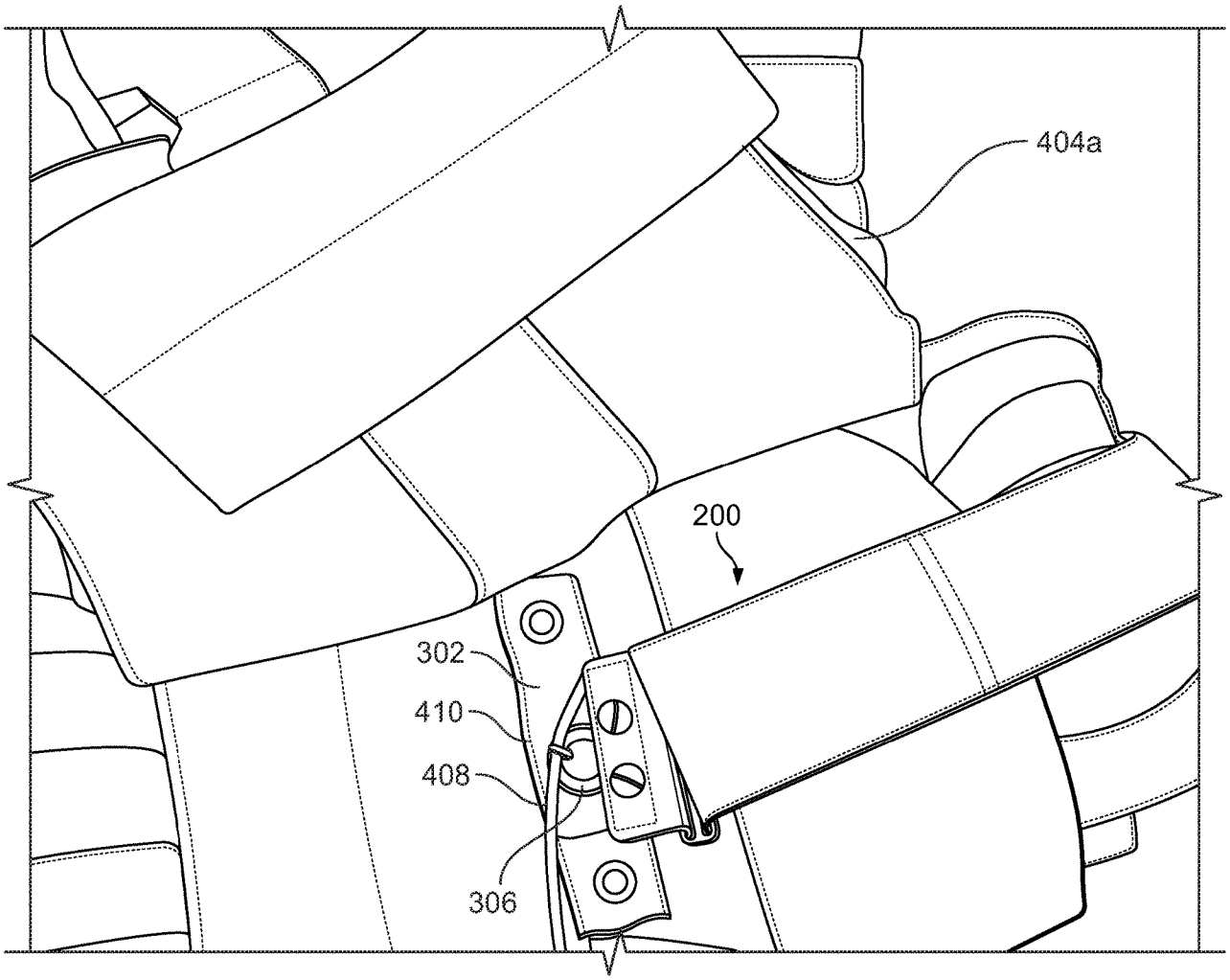

FIGS. 13A-13G show various close-up views of a cord being inserted into a loop of a ballistic vest according to this disclosure. FIGS. 13A and 13B show the loop 410 extending from the back section 404 of the vest 400. FIG. 13C shows the loop 410 extending through a bore of an end portion of one of the shoulder sections 412 positioned over the back section 404. FIG. 13D shows the loop 410 extending through a bore of an end portion of one of the lateral sections 406 positioned over the end portions of the shoulder sections 412. FIG. 13E shows the loop 410 extending through the grommet 306 of the anchor 300 positioned over the end portions of the lateral sections 406. FIG. 13F shows the cord 408 being routed through the loop 410 over the anchor 300. FIG. 13G shows the cord 408 routed through the loop 410 over the anchor 300 such that the flap 404*a* can be lowered and cover the loop 410.

In some embodiments, the strap 206 is an assembly of strap portions, where a first strap portion, with the first strap end portion, including the ratcheting mechanism, and a second strap portion, with the second strap end portion, including the anchor 300, are distinct from each and are thus coupled to each other to define the strap 206, such as via attaching, fastening, mating, interlocking, adhering, buckling, or other coupling ways. For example, the first strap portion can include a slide adjuster through which the second portion is looped through and then secured thereunto, which may be via a pair of opposing coupling interfaces, as disclosed herein.

Figure 14:
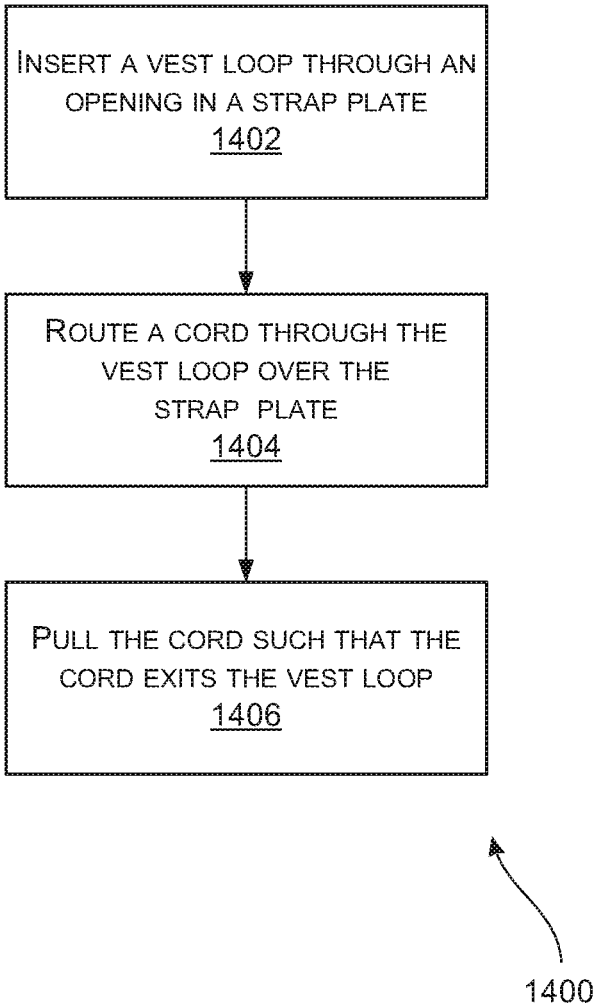
FIG. 14 shows a flowchart of an example embodiment of a method for assembling a vest and disassembling the vest according to this disclosure.

FIG. 14 shows a flowchart of an example embodiment of a method for assembling a vest and disassembling the vest according to this disclosure. A method 1400 is used to assemble a vest, such as the vest 100 or the vest 200. The method 1400 includes a plurality of blocks 1402-1406.

In block 1402, when assembling the vest in accordance with this disclosure, such as exemplified in FIGS. 13A-13C, a vest loop, such as the loop 410, is inserted through an opening, such as an opening of the grommet 306, in a strap plate, such as the plate 302. One way of performing this action is exemplified in FIGS. 13D-13E. However, note that other ways of performing this action are possible. In some embodiments, the grommet 306 is absent and the opening is defined within the plate.

In block 1404, likewise, when assembling the vest in accordance with this disclosure, such as exemplified in FIGS. 13A-13E, a cord, such as the cord 408, is routed through vest loop over the strap plate. This may lead to a configuration as shown in FIG. 8. For example, at least due to resulting outward pressure exerted onto the loop 410 via the shoulder sections 412, the lateral sections 406, and the grommet 306, the vest 400 may be at least partially secured to the user via the cord. One way of performing this action is exemplified in FIGS. 13F-13G. However, note that other ways of performing this action are possible.

In block 1406, however, when disassembling the vest in accordance with this disclosure, such as shown in FIGS. 11A-11B, the cord is pulled such that the cord exits the vest loop. One way of performing this action is exemplified in FIGS. 12D-12E. However, note that other ways of performing this action are possible.

In some embodiments, a vest with a lateral strap, as disclosed herein, can be quickly released from a user via a cord, as disclosed herein, where the lateral strap is adjustable via or hosts a non-ratchet mechanism. This mechanism can be of any type, such as fastening, hook-and-looping, buckling, mating, interlocking, or others.

In some embodiments, various functions or acts can take place at a given location and/or in connection with the operation of one or more apparatuses or systems. In some embodiments, a portion of a given function or act can be performed at a first device or location, and a remainder of the function or act can be performed at one or more additional devices or locations.

The corresponding structures, materials, acts, and equivalents of all means or step plus function elements in the claims below are intended to include any structure, material, or act for performing the function in combination with other claimed elements as specifically claimed. The embodiments were chosen and described in order to best explain the principles of the disclosure and the practical application, and to enable others of ordinary skill in the art to understand the disclosure for various embodiments with various modifications as are suited to the particular use contemplated.

The diagrams depicted herein are illustrative. There can be many variations to the diagram or the steps (or operations) described therein without departing from the spirit of the disclosure. For instance, the steps can be performed in a differing order or steps can be added, deleted or modified. All of these variations are considered a part of the disclosure. It will be understood that those skilled in the art, both now and in the future, can make various improvements and enhancements which fall within the scope of the claims which follow.

The description of this disclosure has been presented for purposes of illustration and description, but is not intended to be fully exhaustive and/or limited to the disclosure in the form disclosed. Many modifications and variations in techniques and structures will be apparent to those of ordinary skill in an art without departing from a scope and spirit of this disclosure as set forth in the claims that follow. Accordingly, such modifications and variations are contemplated as being a part of this disclosure. A scope of this disclosure is defined by various claims, which include known equivalents and unforeseeable equivalents at a time of filing of this disclosure.

The invention claimed is:

1. A device comprising:

a vest including a front section and a back section;

a strap including a first strap end portion and a second strap end portion, wherein the first strap end portion is coupled to the front section;

a linear rack including a first rack end portion and a second rack end portion, wherein the first rack end portion is coupled to the first strap end portion; and a pawl engaging the linear rack, wherein the pawl is coupled to the strap between the first strap end portion and the second strap end portion such that a distance between the pawl and the first strap end portion is decreased as the pawl engages the linear rack away from the second rack end portion towards the first rack end portion and such that the distance between the pawl and the first strap end portion is increased as the pawl disengages the linear rack away from the first rack end portion towards the second rack end portion, wherein the strap extends below an armpit of a wearer of the vest along a lateral side of the wearer when the wearer wears the vest.

2. The device of claim 1, further comprising:

a lateral section extending between the front section and the back section, wherein the strap includes a first side and a second side, wherein the first side opposes the second side, wherein the first side faces the lateral section, wherein the second side is between the first side and the linear rack, wherein the second side includes a first coupling interface and a second coupling interface, wherein the first coupling interface is coupled to the second coupling interface such that the strap is folded, wherein the lateral section extends below the armpit of the wearer of the vest along the lateral side of the wearer when the wearer wears the vest, wherein the first side is an inner side, wherein the second side is an outer side.

3. The device of claim 1, wherein the pawl is coupled to the strap at a strap point, wherein the strap forms a concave shape between the strap point and the first strap end portion as the distance between the pawl and the first strap end portion is decreased.

4. The device of claim 1, further comprising:

a lateral section extending between the front section and the back section, wherein the strap includes a first side and a second side, wherein the first side opposes the second side, wherein the first side faces the lateral section, wherein the second side is between the first side and the linear rack, wherein the first side includes a first coupling interface and a second coupling interface, wherein the first coupling interface is coupled to the second coupling interface such that the strap is folded, wherein the lateral section extends below the armpit of the wearer of the vest along the lateral side of the wearer when the wearer wears the vest, wherein the first side is an inner side, wherein the second side is an outer side.

5. The device of claim 1, further comprising:

a slide adjuster mounted onto the strap between the first strap end portion and the second strap end portion; and a plate coupled to the slide adjuster, wherein the plate is coupled to the back section.

6. The device of claim 1, further comprising:

a cord, wherein the vest includes a shoulder section and a loop, wherein the shoulder section extends between the front section and the back section, wherein the back section includes the loop, wherein the cord extends from the shoulder section through the loop such that the vest unsecures from a user thereof when the cord is pulled from the shoulder section.

7. The device of claim 6, further comprising:

a plate with a grommet, wherein the plate is coupled to the strap, wherein the loop extends through the grommet before the vest is unsecured from the user.

8. The device of claim 1, wherein the strap includes a pocket between the first strap end portion and the second strap end portion, wherein the linear rack extends into the pocket, wherein the pocket has a mouth extending below the armpit of the wearer of the vest along the lateral side of the wearer when the wearer wears the vest.

9. The device of claim 8, wherein the linear rack moves into the pocket as the distance increases.

10. The device of claim 8, wherein the linear rack moves out of the pocket as the distance decreases.

11. The device of claim 1, wherein the pawl includes a tab structured to cause the pawl to engage the linear rack towards the first strap end portion away from the second strap end portion as the tab is pulled away from the linear rack, wherein the tab extends below the armpit of the wearer of the vest along the lateral side of the wearer when the wearer wears the vest.

12. The device of claim 1, wherein the pawl includes a release button structured to cause the pawl to disengage the linear rack away from the first strap end portion towards the second strap end portion as the button is activated, wherein the release button extends below the armpit of the wearer of the vest along the lateral side of the wearer when the wearer wears the vest.

13. The device of claim 1, wherein the first strap end portion is coupled to the front section via buckling.

* * * * *